US008725052B2

(12) United States Patent
Honan et al.

(10) Patent No.: US 8,725,052 B2
(45) **Date of Patent: *May 13, 2014**

(54) WAX MANAGEMENT SYSTEM

(75) Inventors: James Stephen Honan, Spencerport, NY (US); David D. Putnam, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 306 days.

This patent is subject to a terminal disclaimer.

(21) Appl. No.: 13/249,341

(22) Filed: Sep. 30, 2011

(65) Prior Publication Data

US 2013/0084115 A1 Apr. 4, 2013

(51) Int. Cl.
*G03G 15/20* (2006.01)

(52) U.S. Cl.
USPC ..... 399/341

(58) Field of Classification Search
USPC ..... 399/341, 342; 430/124.13
See application file for complete search history.

(56) References Cited

U.S. PATENT DOCUMENTS

| | | | | |
|---|---|---|---|---|
| 3,938,992 | A | 2/1976 | Jadwin et al. | |
| 3,941,898 | A | 3/1976 | Sadamatsu et al. | |
| 4,076,857 | A | 2/1978 | Kasper et al. | |
| 4,160,644 | A | 7/1979 | Ryan | |
| 4,229,513 | A | 10/1980 | Merrill et al. | |
| 4,332,444 | A * | 6/1982 | Nozawa et al. | 396/71 |
| RE31,072 | E | 11/1982 | Jadwin et al. | |
| 4,414,152 | A | 11/1983 | Santilli et al. | |
| 4,416,965 | A | 11/1983 | Sandhu et al. | |
| 4,779,558 | A * | 10/1988 | Gabel et al. | 118/46 |
| 4,908,669 | A * | 3/1990 | Yamamoto | 399/335 |
| 5,057,392 | A | 10/1991 | McCabe et al. | |
| 5,089,547 | A | 2/1992 | McCabe et al. | |
| 5,102,765 | A | 4/1992 | McCabe et al. | |
| 5,112,715 | A | 5/1992 | DeMejo et al. | |
| 5,147,747 | A | 9/1992 | Wilson et al. | |
| 5,256,507 | A | 10/1993 | Aslam et al. | |
| 5,780,195 | A | 7/1998 | Nava | |
| 6,549,746 | B2 * | 4/2003 | Hauptmann | 399/341 |
| 6,915,100 | B2 * | 7/2005 | Tani et al. | 399/329 |
| 7,421,237 | B2 | 9/2008 | Funato et al. | |
| 7,454,162 | B2 | 11/2008 | Segerer et al. | |
| 7,756,461 | B2 | 7/2010 | Sato et al. | |
| 2010/0021838 | A1 | 1/2010 | Putnam et al. | |
| 2013/0084114 | A1 * | 4/2013 | Honan et al. | 399/341 |
| 2013/0084116 | A1 * | 4/2013 | Putnam et al. | 399/341 |

FOREIGN PATENT DOCUMENTS

| | | |
|---|---|---|
| JP | 2002-091205 | 3/2002 |
| JP | 2005-043532 | 2/2005 |
| JP | 2005-266079 | 9/2005 |
| JP | 2006-091146 | 4/2006 |

* cited by examiner

*Primary Examiner* — Robert Beatty
(74) *Attorney, Agent, or Firm* — Roland R. Schindler, II

(57) ABSTRACT

Wax management systems are provided. In one aspect a wax management system has print positioning system having an input to receive a fused toner print having a toner image with a viewing surface that has first portions with wax globules and second portions without wax globules and a print positioning apparatus that arranges the print for wiping by a wiping system having a wiping surface that wipes the viewing surface to move at least some of the wax from the wax globules onto the second portion. A wax management device controller determines when fused toner print is at a temperature where the toner image is below a glass transition temperature of the toner and the wax is below a melting temperature for the wax and to position the print for wiping. The controller causes the wiping system to wipe the print after the controller makes the determination.

23 Claims, 18 Drawing Sheets

WAX MANAGEMENT SYSTEM

CROSS REFERENCE TO RELATED APPLICATIONS

This application relates to commonly assigned, copending U.S. application Ser. No. 13/249,345, filed Sep. 30, 2013, entitled: "PRINTER WITH WAX MANAGEMENT SYSTEM"; U.S. application Ser. No. 13/249,333, filed Sep. 30, 2013, entitled: "METHOD FOR MANAGING WAX ON A PRINT" each of which is hereby incorporated by reference.

FIELD OF THE INVENTION

This invention pertains to the field of printing.

BACKGROUND OF THE INVENTION

In toner printing a pattern of toner particles is formed and transferred to a receiver. The transferred toner particles are then fused to create adhesive bonds between the toner particles and between the toner particles and the receiver. In most commercial applications, fusing is performed using a process known as contact fusing. In a contact fusing system, the pattern of toner particles and the receiver are passed through a nip between a heated roller and a pressure roller. The heated roller and the pressure roller are biased toward each other and press the pattern of toner particles and the receiver together while the heated roller heats the toner particles and the receiver. The pressure and heat applied during fusing creates the adhesive bonds that form a fused toner image that is bound to the receiver.

Adhesive bonds also arise between the toner particles and the heated roller during contact fusing. Where the adhesive bonds between the toner particles and the heated roller are weaker than the adhesive bonds between the toner particles within the toner image and the adhesive bonds between the toner particles and the receiver, the toner particles separate from contact with the heated roller, remain on the receiver, and cool to form the fused toner image. However, where the adhesive bonds between the heated roller and the toner particles are stronger than the adhesive bonds between the toner particles in the toner image or when the adhesive bonds between the heated roller and the toner particles are stronger than the adhesive bonds between the toner particles, and the receiver, toner particles can separate from the toner image and adhere to the heated roller. This is known as toner offset. Toner offset creates unwelcome artifacts in the toner image being fused by removing toner necessary for the toner image that is being fused. Further, the toner that remains on the heated roller creates unwelcome artifacts in subsequently fused images by transferring to later toner prints or by forming relief patterns in such later formed toner images.

In some toner printers, elongated belts are used for fusing that have the effect of reducing toner offset. One example of this is described in U.S. Pat. No. 5,256,507 (issued Oct. 26, 1993, in the name of Aslam et al). As is described in the '507 patent, an elongated web is heated to fuse the toner image and then cooled to facilitate ready separation of the receiver member with the toner image fixed thereto from the elongated web. The elongated web arrangement also serves to increase the glossiness of the toner image. As a result, this arrangement is particularly useful for multi-color toner image fusing.

Alternatively, other toner printers apply a fusing oil to the heated roller in order to reduce the adhesion between the heated roller and the toner. However, the use of such oil creates new press operating requirements by requiring additional handling of the oil and by requiring procedures and equipment to ensure that oil is applied in a consistent manner. Additionally, at least some of the fusing oil can transfer from the heated roller onto the print creating a print having image quality and handling problems.

In another alternative, toner printers have been developed that use toner particles that incorporate a wax. During fusing such toner particles are heated at least to a glass transition temperature of the toner and to an incorporated melting temperature of the incorporated wax. This causes the wax to liquefy and to separate from the pattern forming material to form a slip layer between the toner particles and a heated fuser roller. The slip layer reduces extent of adhesive bonds between the heated fuser roller and the toner particles and lowers the likelihood of toner offset. However, after fusing, the wax remains on the toner image and creates gloss and image density variations that can lower the perceived quality of toner images made using toners of this type. This is a particular problem with high gloss images that require high fusing temperatures.

One alternative approach is to remove wax from the toner image during fusing. For example, JP2005043532A entitled: "A fixing apparatus and an image forming device" describes a fixing apparatus having a heating roller wherein any surplus amount of wax is removed from the toner image by being drawn into pores in the heating roller. Similarly, JP2006091146A entitled: "An Image Forming Device and a Fixing Apparatus" describes toner image is formed using the toner containing a resin binder, a coloring material and the wax for improving the releasability. In these publications a wax bearing toner is transferred onto a recording sheet and the toner is fixed by a fixing device under heat and pressure. The fixing device has a heating roller in the form of a hollow cylindrical member made of a metal and has a large number of pores extending from the peripheral face of the heating roller and to the hollow part thereof.

According to the '532 publication, when toner is heated, the melting wax forms a layer and is drawn into the pores by capillary action and removed. The wax is absorbed by a glass fiber layer formed inside the heating roller and held. The '532 publication further suggests that since the excess of wax is removed from the surface of the toner image, the gloss unevenness is restrained without making the toner image remarkably highly glossy even when the toner image is suddenly cooled after fixing.

Another approach is shown in JP2005266079A entitled: "Image Forming Apparatus, Wax Removal Device and Image Forming Method". The '079 publication describes the use of a wax removal part that allows a blade to contact the surface of a recording medium that is at a temperature range not lower than the melting point of the wax included in toner and lower than the melting point of the toner material. The blade removes the melted wax on the surface of the recording medium. A distance between the fixing device and the blade is determined so that the recording medium causes a temperature drop in accordance with the conveyance and the temperature of the surface falls into the temperature range.

Another publication, JP 2002-091205A entitled: "Image forming apparatus" describes another printer with a wax removal system. In one embodiment the wax removal system has a rolling-up (continuous) type web cleaning device and a film anchorage device that positions the web for cleaning. According to the '205 publication, the wax on a recording medium can fully be cleaned by placing a web on a cleaning roller and rolling the cleaning roller in a direction that is the reverse of a direction of movement of a recording medium. The web can be a porous body material which comprises a natural or natural fibrous body or polyester, polypropylene, polyethylene, etc. However, other webs can be used.

The '205 publication also notes in order to acquire a picture without the further loss of density and gloss caused by wax, the cooling temperature in an exfoliation point is lower than the softening temperature of this recording-medium resin, and it is desirable that it is higher than the melting point of a wax. The '205 publication further notes that it will become granular (the wax which began to melt from a toner in this intermediate transfer body and this recording-medium interface) and will adhere on this recording medium after exfoliation if it exfoliates at a temperature lower than wax melting point temperature under the state where this intermediate transfer body and this recording medium touch.

In general then, the approaches of the '507, '146, '079 and '205 publications attempt to resolve the wax problem by cleaning wax from the surface of the toner image. However, it will be appreciated that attempting to fully clean wax from the surface of a toner image can create a risk of damaging the toner image as generally such cleaning processes involve cleaning structures that are held against the toner image while applying cleaning forces to remove the wax from the toner image. Such cleaning processes pose a particular risk of damaging portions of the toner image that have significant variations in toner stack heights such as regions of high density color where many different types of toner are applied or in regions where toner is applied to build toner stack heights that are high enough to create tactile effects.

The risks of damaging the toner image are particularly acute when such cleaning is performed when the toner is at an elevated temperature. Yet in each of the '536, '136, '079 and '205 publications wax removal is performed when the wax is heated to a temperature sufficient to liquefy the wax. As the wax is in intimate contact with the toner image, this necessarily involves removing wax when the toner image is at an elevated temperature and is more vulnerable to damage.

For example, in the '536 and '136 publications, wax is cleaned at the fusing nip while the wax is in a liquid form and the toner is at or above the glass transition temperature for the toner. These in-the-nip cleaning approaches can be compromised by the risk that the fusing process will interfere with the wax cleaning process, and by the risk that the wax cleaning process will reduce the effectiveness of the fusing process. These in-the-nip cleaning approaches further require the use of complex heating roller designs that are capable of removing such wax while also providing heat and pressure to the toner image in the nip.

Similarly, in the '079 publication and the '205 publication, the toner image is allowed to cool below a glass transition temperature for the toner but while the wax is heated above the melting temperature of the wax. As an initial matter, these approaches are only useful for toners that have wax components with wax melting temperatures that are below a glass transition temperature of the toner. Further, these approaches risk damaging the toner image because they require the application of cleaning forces to the toner image when the temperature of the wax is above a melting temperature of the wax and the temperature of the underlying toner is at or close to the same elevated temperature.

What is needed in the art therefore are new methods, fusing systems and printers that enable a toner image to be formed using a toner with a wax while also managing the presence of any such wax on the toner image to eliminate density and gloss variations that without creating damaging the toner image.

SUMMARY OF THE INVENTION

Wax management systems are provided. In one aspect a wax management system has print positioning system having an input to receive a fused toner print having a toner image with a viewing surface that has first portions with wax globules and second portions without wax globules and a print positioning apparatus that arranges the print for wiping by a wiping system having a wiping surface that wipes the viewing surface to move at least some of the wax from the wax globules in the first portion onto the second portion. A wax management device controller determine when the received toner image is at a temperature where the toner image is below a glass transition temperature of the toner and the wax is below a melting temperature for the wax and to position the received fused toner print for wiping. The controller causes the wiping system to wipe the fused toner print after the controller determines that the fused toner print is at a temperature where the toner image is below a glass transition temperature of the toner and the wax is below a melting temperature for the wax.

DETAILED DESCRIPTION OF THE DRAWINGS

Figure 1:
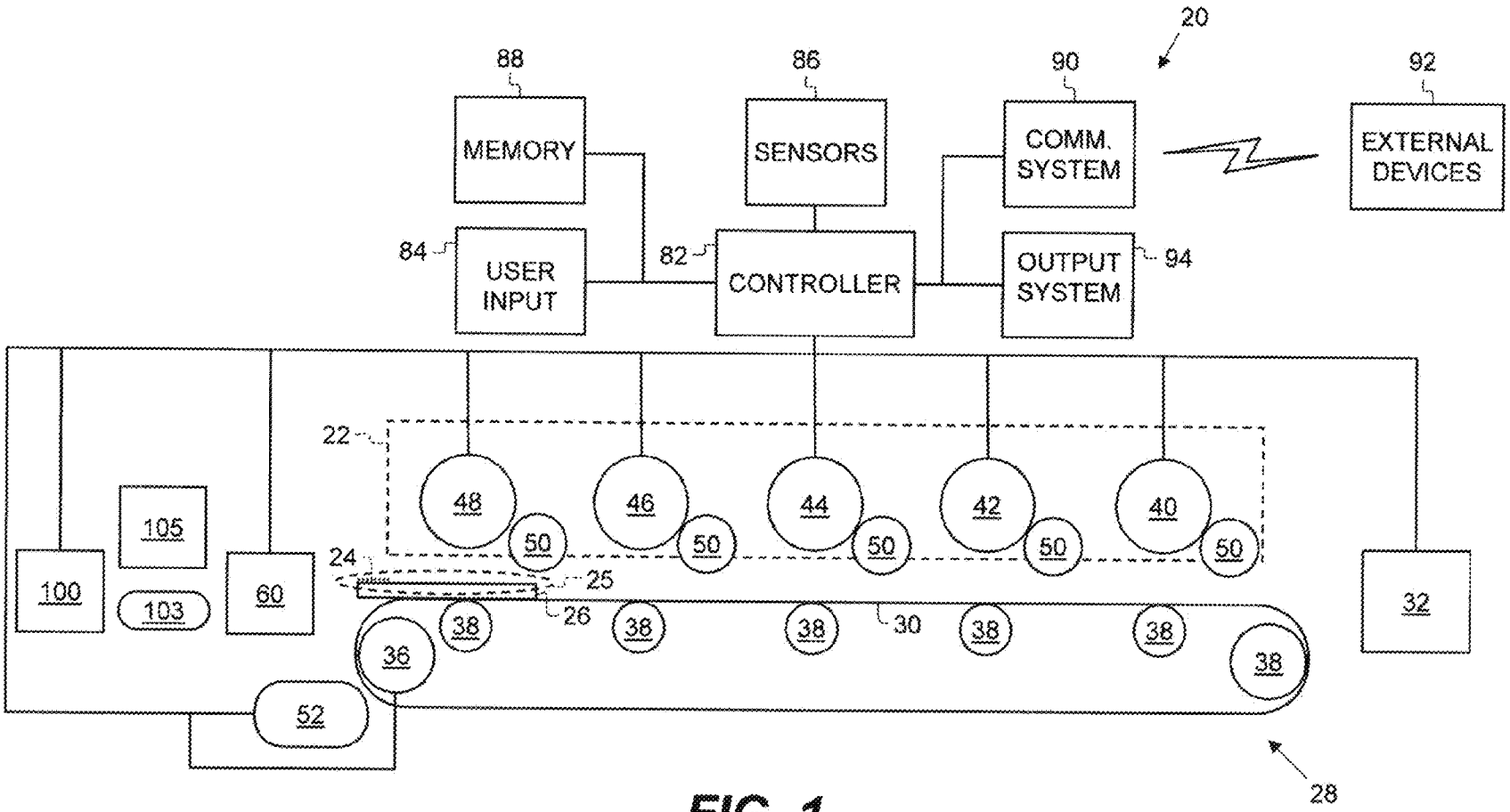
FIG. 1 shows a first embodiment of a toner printer having a wax management system.

FIG. 1 is a system level illustration of a toner printer 20. In the embodiment of FIG. 1, toner printer 20 has a print engine 22 that arranges a toner 24 to form a toner image 25. Toner image 25 can include any pattern of toner 24 and can be mapped according data representing text, graphics, photo, and other types of visual content, as well as patterns that are determined based upon desirable structural or functional arrangements of toner 24.

Toner 24 can include one or more polymeric binder resins (toner resins) which can be optionally colored by one or more colorants. Colorants which can be pigments, dyes, and other limited wavelength light absorbers suitable for use in the practice of the present invention are disclosed, for example, in U.S. Reissue Pat. No. 31,072, and in U.S. Pat. Nos. 4,160,644; 4,416,965; 4,414,152; and 4,229,513. As the colorants, known colorants can be used. The colorants include, for example, carbon black, Aniline Blue, Calcoil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 185, C.I. Pigment Yellow 155, C.I. Pigment Yellow 97, C.I. Pigment Yellow 12, C.I. Pigment Yellow 17, C.I. Pigment Blue 15:1, and C.I. Pigment Blue 15:3. Colorants can generally be employed in the range of from about 1 to about 90 weight percent on a total toner powder weight basis, and preferably in the range of about 2 to about 40 weight percent, more preferably from 4 to 30 weight percent, and most preferably 6 to 20 weight percent in the practice of this invention. When the colorant content is 4% or more and preferably 6% or more by weight, a sufficient coloring power can be obtained, and when it is 30% or less and more preferably 20% or less by weight, good transparency can be obtained. Mixtures of colorants can also be used. Colorants in any form such as dry powder, its aqueous or oil dispersions or wet cake can be used in the present invention. Colorant milled by any methods like media-mill or ball-mill can be used as well. The colorant may be incorporated, e.g., in the oil phase of limited coalescence process, or in the first aqueous phase of a multiple emulsion process as disclosed in U.S. Publication No. 2010/0021838.

The toner resin can be selected from a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; 5,780,195 and the like, all incorporated herein by reference. Preferred resin or binder materials include polyesters.

Known binder resins are useable as the polymeric binder. These binder resins include, e.g., homopolymers and copolymers such as polyesters, styrenes, e.g. styrene and chlorostyrene; monoolefins, e.g. ethylene, propylene, butylene and isoprene; vinyl esters, e.g. vinyl acetate, vinyl propionate, vinyl benzoate and vinyl butyrate; alpha.-methylene aliphatic monocarboxylic acid esters, e.g. methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers, e.g. vinyl methyl ether, vinyl ethyl ether and vinyl butyl ether; and vinyl ketones, e.g. vinyl methyl ketone, vinyl hexyl ketone and vinyl isopropenyl ketone. Particularly desirable binder polymers/resins include polystyrene resin, polyester resin, styrene/alkyl acrylate copolymers, styrene/alkyl methacrylate copolymers, styrene/acrylonitrile copolymer, styrene/butadiene copolymer, styrene/maleic anhydride copolymer, polyethylene resin and polypropylene resin. They further include polyurethane resin, epoxy resin, silicone resin, polyamide resin, modified rosin, paraffins and waxes. Also, especially useful are polyesters of aromatic or aliphatic dicarboxylic acids with one or more aliphatic diols, such as polyesters of isophthalic or terephthalic or fumaric acid with diols such as ethylene glycol, cyclohexane dimethanol and bisphenol adducts of ethylene or propylene oxides.

In a toner printer 20 that uses an electrophotographic print engine 22, toner 24 takes the form of toner particles that are charged and developed in the presence of an electrostatic latent image to convert the electrostatic latent image into a visible image. Toner particles without colorant can provide, for example, a protective layer on an image or that impart a tactile feel or other functionality to the printed image. Toner 24 has toner particles that include at least a polymeric binder resin and a wax at least some of which can separate from the toner particles to reduce adhesion between the toner particles and a heated fuser roller.

Toner particles can have any of a variety of ranges of median volume diameters, e.g. less than 8 μm, on the order of 10-15 μm, up to approximately 30 μm, or larger. When referring to particles of toner 24, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. Toner 24 is also referred to in the art as marking particles or dry ink.

Typically receiver 26 takes the form of paper, film, fabric, metal bearing films, metal bearing fabrics, or metallic sheets, fibers or webs, and can be made from naturally occurring materials or artificial materials. However, receiver 26 can take any number of forms and can comprise, in general, any article or structure that can be moved relative to print engine 22 and processed as described herein.

In the embodiment of FIG. 1, print engine 22 is used to deposit one or more patterns of toner 24 to form toner image 25 on receiver 26. A toner image 25 formed from a single application of toner 24 can, for example, provide a monochrome image. A toner image 25 can also be formed by combining two or more toner images in registration. A toner image 25 that is formed in this manner can be used for a variety of purposes, the most common of which is to provide a toner image 25 that can include any of a wide range of colors. For example, a toner image 25 can include four toners 24 having subtractive primary colors, cyan, magenta, yellow, and black. Any of these four colors of toner 24 can be combined with toner 24 of one or more of the other colors at a particular location on receiver 26 to form any of a wide range of colors that are different than the colors of the individual toners 24 combined at that location. Similarly, in a five toner image various combinations of any of five differently colored toners 24 can be combined to form other colors on receiver 26 at various locations on receiver 26.

In the embodiment of FIG. 1 print engine 22 is illustrated as having an optional arrangement of five printing modules 40, 42, 44, 46, and 48, arranged along a length of receiver transport system 28. Each printing module delivers a single application of toner 24 to a respective transfer subsystem 50 in accordance with a desired pattern as receiver 26 is moved by receiver transport system 28. Receiver transport system 28 comprises a movable surface 30 that moves receiver 26 relative to printing modules 40, 42, 44, 46, and 48. Surface 30 comprises an endless belt that is moved by motor 36, that is supported by rollers 38, and that is cleaned by a cleaning mechanism 52.

Figure 2:
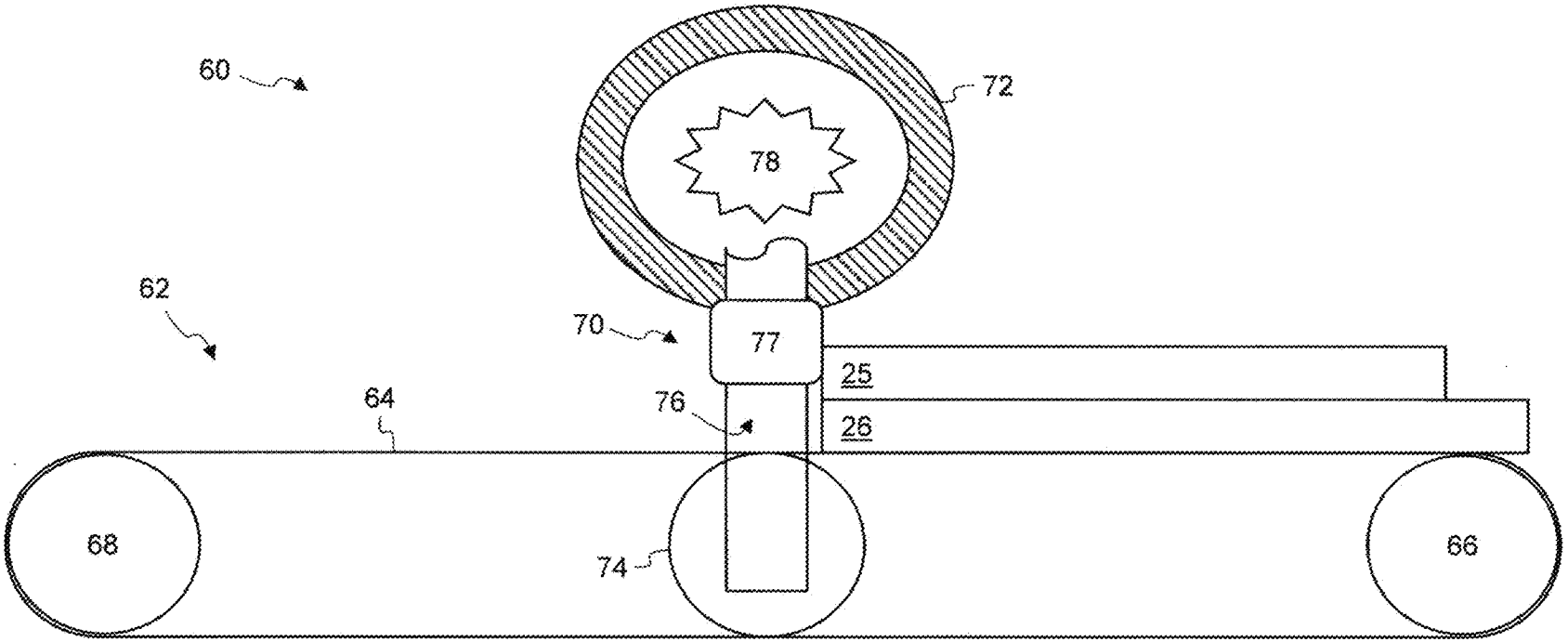
FIG. 2 shows a first embodiment of a fusing system.

In the embodiment of FIGS. 1 and 2 printing modules 40, 42, 44, 46, and 48 can each have a primary imaging member (not shown) on which a toner image 25 can be formed using an electrophotographic process. In one example of the electrophotographic process, the primary imaging member (not shown) is as a photoreceptor that is initially charged to a generally uniform difference of potential relative to a ground. An electrostatic latent image is formed by image-wise exposing the primary imaging member using known methods such as optical exposure, an LED array, or a laser scanner. The electrostatic latent image is developed into a visible image by bringing the primary imaging member into close proximity to a development station that contains a charged toner 24. A development potential is applied at the development station that causes charged toner 24 to develop on the primary imaging member (not shown) according to the electrostatic latent image at each engine pixel location. This forms toner image 25 on primary the primary imaging member.

Each toner image 25 is transferred to a respective transfer subsystem 50 that presses toner image 25 against receiver 26 while subjecting toner image 25 to an electrostatic field that urges toner image 25 to transfer onto receiver 26. In other embodiments, printer 20 can use a print engine 22 that forms a toner image 25 on receiver 26 in any other manner consistent with what is claimed herein.

After toner image 25 is transferred to receiver 26, receiver 26 is moved by receiver transport system 28 to fuser 60. FIG. 2 shows one embodiment of fuser 60. In this embodiment, fuser 60 comprises a fuser receiver transport system 62 having a transport belt 64 supported by a motorized roller 66 and a support roller 68. In operation, motorized roller 66 responds to signals from a printer controller 82 to cause transport belt 64 to move receiver 26 and toner image 25 through a fusing nip 70 between a heated roller 72 and a pressure roller 74. In this embodiment, pressure control system 76 applies a pressure that drives heated roller 72 and pressure roller 74 toward each other. Heated roller 72 is heated to a fusing temperature by a heater 78 which in this embodiment is an internal radiant type heater. Accordingly, when toner image 25 and receiver 26 enter nip 70, toner image 25 is pressured into direct contact with heated roller 72 so that thermal energy from heated roller 72 is transferred directly into toner image 25. Pressure control system 76 can comprise any mechanical structure that can provide an amount of pressure between heated roller 72 and pressure roller 74 when a toner image 25 and receiver 26 are situated therebetween. It will be appreciated that this type of fusing system is not critical and that in other embodiments, fuser 60 can comprise other known contact fusing systems including systems that use a heated belt to apply heat to a toner image during fusing.

In the embodiment of FIG. 2, an optional actuator 77 is provided that can cooperate with an embodiment of pressure control system 76 such as a spring tensioning system (not illustrated) to control the amount of pressure applied between heated roller 72 and pressure roller 74.

Returning to FIG. 1, printer controller 82 is in communication with and operates toner printer 20 based upon input signals from a user input system 84, sensors 86, a memory 88 and a communication system 90. User input system 84 can comprise any form of transducer or other device capable of receiving an input from a user and converting this input into a form that can be used by printer controller 82. For example, user input system 84 can comprise a touch screen input, a touch pad input, a 4-way switch, a 6-way switch, an 8-way switch, a stylus system, a trackball system, a joystick system, a voice recognition system, a gesture recognition system or other such systems. Sensors 86 can include contact, proximity, magnetic, or optical sensors and other sensors known in the art that can be used to detect conditions in toner printer 20 or in the environment-surrounding toner printer 20 and to convert this information into a form that can be used by printer controller 82 in governing toner image forming, transferring, fusing, or other functions. Memory 88 can comprise any form of conventionally known memory devices including but not limited to optical, magnetic or other movable media as well as semiconductor or other forms of electronic memory. Memory 88 can be fixed within toner printer 20 or removable from toner printer 20 at a port, memory card slot or other known means for temporarily connecting a memory 88 to an electronic device. Memory 88 can also be connected to toner printer 20 by way of a fixed data path or by way of communication system 90.

Communication system 90 can comprise any form of circuit, system or transducer that can be used to send signals to or receive signals from memory 88 or external devices 92 that are separate from or separable from direct connection with printer controller 82. Communication system 90 can connect to external devices 92 by way of a wired or wireless connection. In certain embodiments, communication system 90 can comprise any circuit that can communicate with one of external devices 92 using a wired connection such as a local area network, a point-to-point connection, or an Ethernet connection. In certain embodiments, communication system 90 can alternatively or in combination provide wireless communication circuits for communication with separate or separable devices using, for example, wireless telecommunication or wireless protocols such as those found in the Institute of Electronics and Electrical Engineers Standard 802.11 or any other known wireless communication systems. Such systems can be networked or point to point communication.

External devices 92 can comprise any type of electronic system that can generate signals bearing data that may be useful to printer controller 82 in operating toner printer 20. For example and without limitation, one example of such external devices 92 can comprise what is known in the art as a digital front end (DFE), which is a computing device that can be used to provide an external source of a print order that has image data and, optionally, production data including printing information from which the manner in which the images are to be printed can be determined. A print order that is generated by such external devices 92 is received at communication system 90 which in turn provides appropriate signals that are received by printer controller 82 for use in determining operation of printer 20.

Similarly, the print order or portions thereof including image and production data can be obtained from any other source that can provide such data to printer 20 in any other manner, including but not limited to memory 88. Further, in certain embodiments image data and/or production data or certain aspects thereof can be generated from a source at printer 20 such as by use of user input system 84 and an output system 94, such as a display, audio signal source or tactile signal generator or any other device that can be used by printer controller 82 to provide human perceptible signals for feedback, informational or other purposes.

To investigate the gloss and density variation problems that are associated with the use of toners having a wax component, the inventors have made test prints with a toner 24 having a polyester binder resin, wax, and colorant using a toner printer 20 of the electrophotographic type. Test prints were prepared for several different toners with test patches of a single toner type having 200% toner laydown and fused. The process speed was 10 ppm and the receiver on which the toner was provided was Utopia Gloss 270 gsm sold by Appleton Coated LLC, Combined Locks, Wis., USA.

Figure 3:
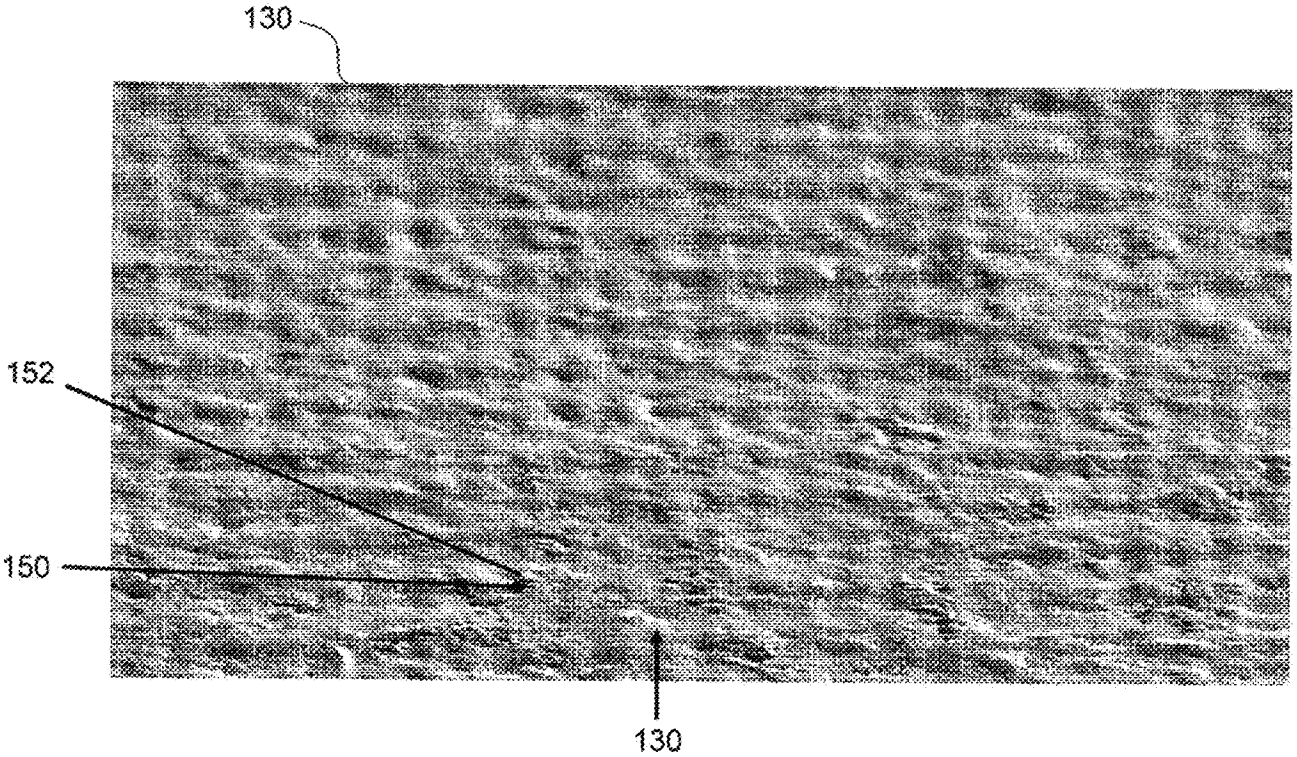
FIG. 3 shows an image of one example of a viewing surface of a toner image fused at a first temperature and having wax globules thereon at 2000× magnification.
Figure 4:
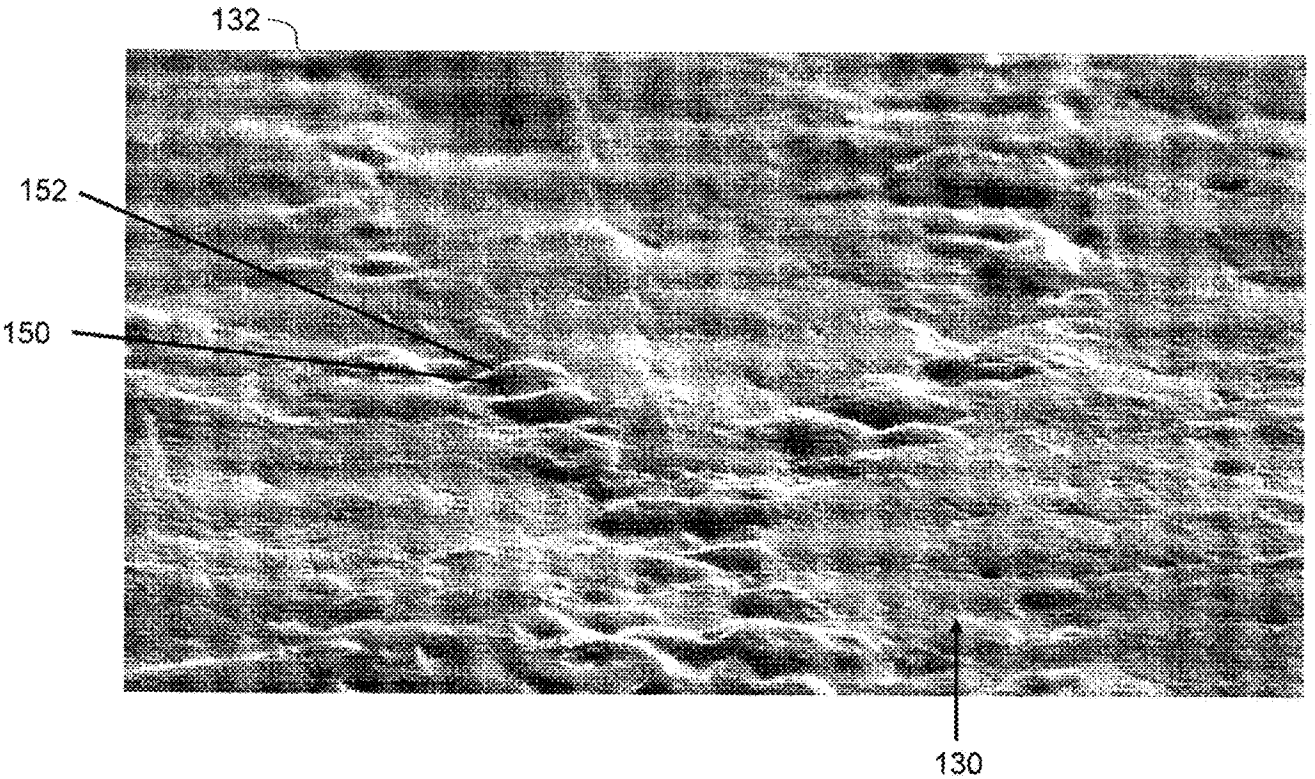
FIG. 4 shows an image of one example of a viewing surface of a toner image fused at the first temperature and having wax globules thereon at 10000× magnification.

FIG. 3 shows an image of one example of a viewing surface 130 of a toner image 25 fused at a first temperature of 140 degrees Celsius and magnified at 2000×, while FIG. 4 shows an image of one example of a viewing surface of a toner image fused at the first temperature of 140 degrees Celsius at a magnification of 10,000×. Through these images it has been discovered that wax 150 takes the form of wax globules 152 on viewing surface 130 of a fused toner image 132 and many of which have indistinct or irregular but generally rounded surfaces above viewing surface 130.

Figure 5:
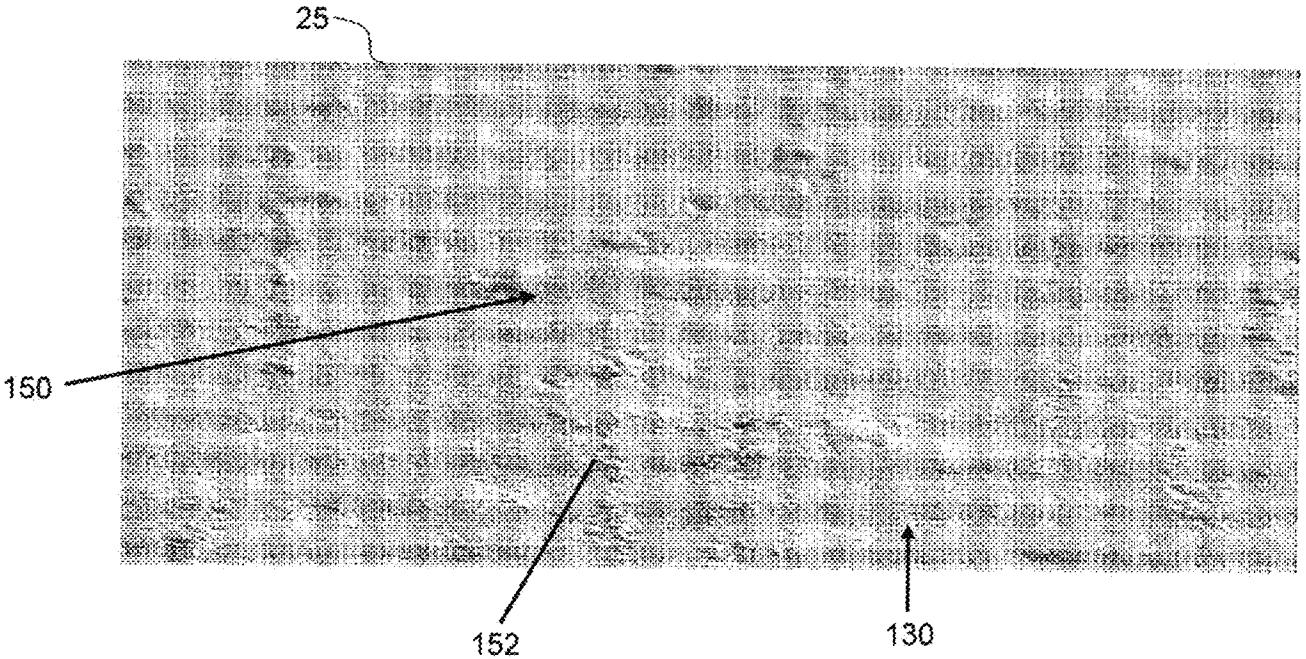
FIG. 5 shows an image of one example of a viewing surface of a toner image fused at a second temperature and having wax globules thereon at 2000× magnification.
Figure 6:
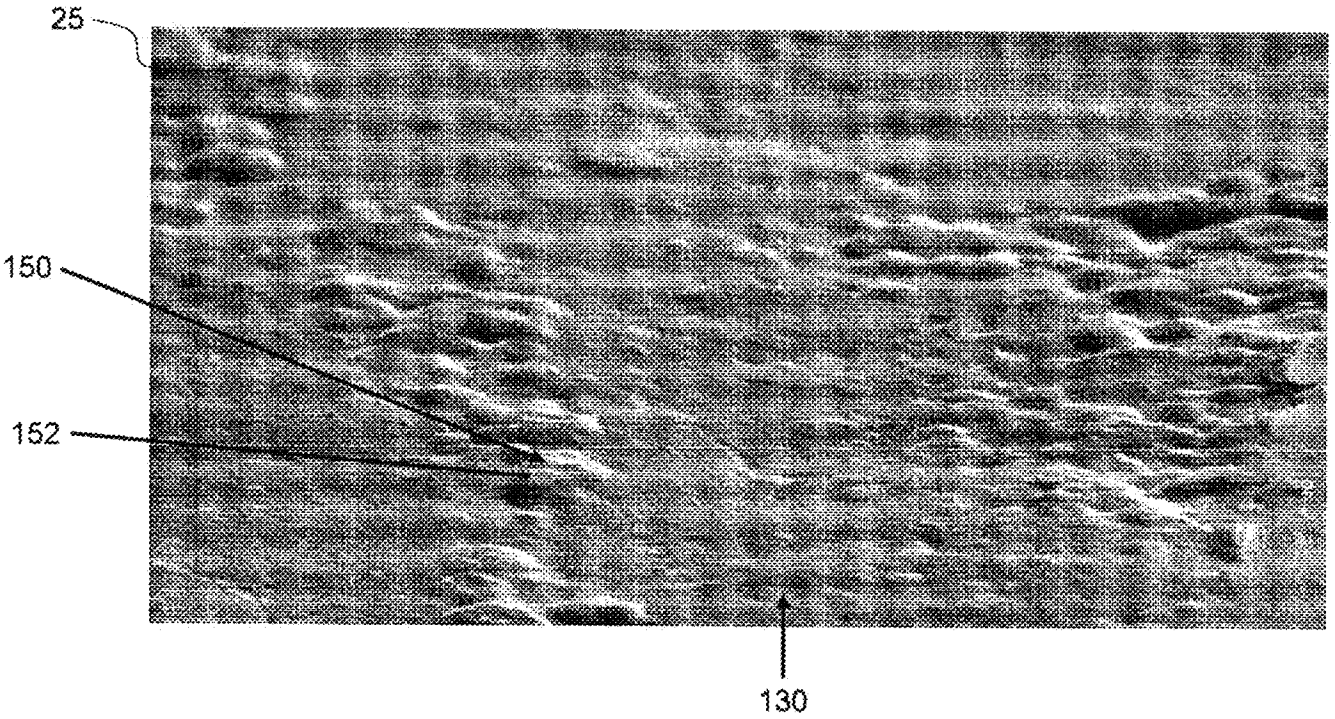
FIG. 6 shows an image of one example of a viewing surface of a toner image fused at the second temperature and having wax globules thereon at 10000× magnification.

Similarly, test prints have been made with a toner 24 having a wax and these test prints have been fused at a higher fusing temperature than the test prints shown in FIGS. 3 and 4. Images of these test prints have also been captured at high magnification and are shown in FIGS. 5 and 6. In particular, FIG. 5 shows a 2000× magnified image of one example of a viewing surface 130 of a toner image 25 that is fused at a temperature of 160 degrees Celsius while FIG. 6 shows a 10000× magnified image of a viewing surface 130 of a toner image 25 that is also fused at a temperature of 160 degrees Celsius. Here too wax 150 is present in the form of wax globules 152.

Figure 7:
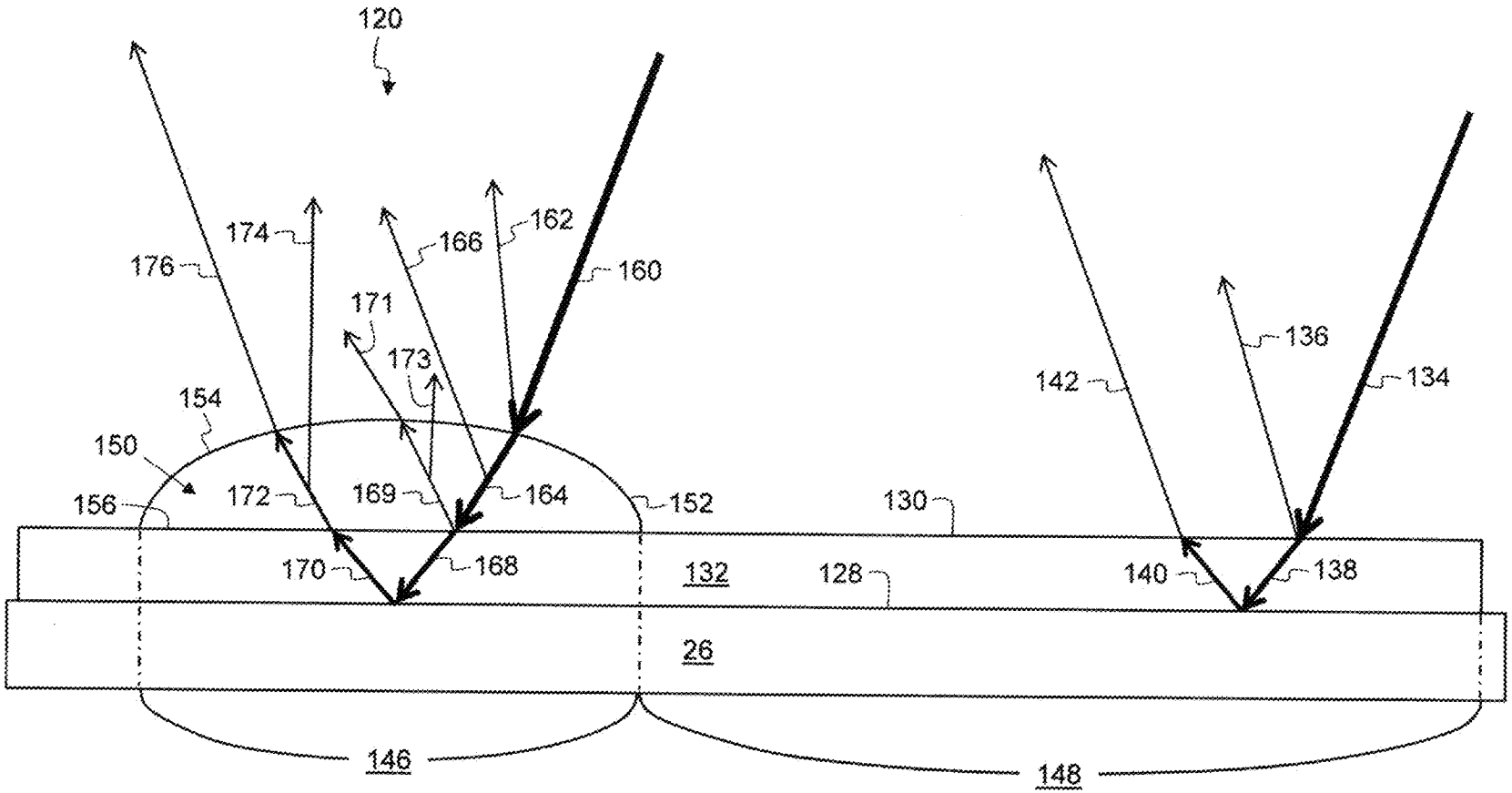
FIG. 7 is a cross-section view of one conceptual model of a toner print generated using toner with a wax after a fusing process that provides a schematic illustration of ways in which light incident on a viewing surface of a toner image is affected by a portion of a toner image without a wax globule and a portion with a wax globule.

FIG. 7 is a cross-section view of one conceptual model of a toner print 20 generated using toner 24 with a wax after a fusing process. FIG. 7 is not to scale but instead is provided to help to illustrate light transmission and reflection of a fused toner image 132 with a viewing surface 130 having first portions 146 with one or more wax globules 152 and second portions 148 that do not have wax globules 152. Accordingly, relative sizes of, shapes or directions of structures or light schematically illustrated in FIG. 7 have been selected to support the following discussion points and actual conditions can vary from those indicated here. It will be understood that the following depiction is not intended as an exhaustive analysis of all effects that a fused toner image and wax globule may have on light but rather to provide a general overview of some readily apparent potential effects.

As is shown in FIG. 7, a fused toner print 120 has a receiver 26 with a fused toner image 132. Fused toner image 132 has a lower surface 128 that is adhesively bonded to receiver 26 during fusing and a viewing surface 130 that presents a toner/air boundary. When light 134 is applied to viewing surface 130, one portion of light 134 is reflected in a specular manner by viewing surface 130 to form a toner gloss reflection 136 and another portion of light 134 passes through toner image 25 as light 138. Light 138 strikes receiver 26 and reflects according to the reflectance characteristics of receiver 26. Where receiver 26 is highly reflective, light 138 will reflect in a more specular manner as is illustrated here, to form receiver reflected light 140 however, where receiver 26 reflects less light in a specular manner, light 138 can be diffusely reflected and a smaller portion of light 138 will reflect as receiver reflected light 140 that travels along the direction of specular reflected light.

To the extent that fused toner image 132 has one or more toners with a colorant therein such as a pigment or dye, certain wavelengths of light 138 and receiver reflected light 140 will be absorbed in part or in whole by these colorant(s). Toner combinations are selected for use in making a toner image such that when fused toner image 132 is exposed to light, fused toner image 132 absorbs particular wavelengths to cause light 142 that emerges from viewing surface 130 to have a desired color content.

As is also shown in FIG. 7, light 142 that emerges from viewing surface 130 travels in a direction that is determined by the angle of incidence of receiver reflected light 140 with viewing surface 130, the index of refraction of the toner image 25 and the index of refraction of air.

As is also shown in FIG. 7, a light 160 that is parallel to light 134 but incident on a portion of a viewing surface 130 that has a wax globule 152 thereon is treated differently from light 134 that is incident on viewing surface 130. In this regard, wax globule 152 has an upper boundary 154 between air and wax 150 forming wax globule 152 and a lower boundary 156 between wax globule 152 and viewing surface 130. As is further shown in FIG. 7, upper boundary 154 has a radius of curvature relative to what is illustrated here for the purposes of discussion as a generally flat viewing surface 130.

Accordingly, when a light 160 confronts upper boundary 154 a first portion of light 160 is reflected by upper boundary 154 in a generally specular manner at an angle determined by a tangent of the curvature of upper boundary 154 to form a wax gloss reflection 162. Wax gloss reflection 162 is reflected in a direction that is different from the direction of toner gloss reflection 136. This creates a variation in the apparent gloss of fused toner image 132 in the region of . the wax globule 152.

A second portion 164 of light 160 passes into wax globule 152 at upper boundary 154 and travels through wax globule 152 at an angle that is determined by the index of refraction of air proximate and the index of refraction of wax globule 152 as well as the angle of incidence of light 160. To the extent that wax 150 is not colorless and to the extent that wax 150 may have non-uniform wax densities or porosity or other materials therein, a portion of light 164 will be absorbed by wax globule 152. Further, wax globule 152 can cause a portion of light 164 to be diffused within wax globule 152 such as by reflection, local illumination or absorption and reemission or other known optical effects. Such effects cause light 166 to appear to reflect or to be emitted from within wax globule 152. Light 166 can have the effect of reducing the apparent density of the portion of fused toner image 132 under wax globule 152.

The remaining portion of light 164 then crosses lower boundary 156 and travels as light 168 at an angle that is determined by the angle of incidence of light 168, the index of refraction of wax 150 and the index of refraction of the toner forming fused toner image 132. As is also illustrated here there can be a secondary toner gloss reflection 169 when light 164 reaches viewing surface 130. However, secondary gloss reflection 169 travels along a different path than toner gloss reflection 136.

Light 168 then travels through fused toner image 132, is partially absorbed by any colorants in fused toner image 132 and is then reflected by receiver 26. The reflection can occur in a more specular manner when receiver 26 is more reflective and in a more diffuse manner when receiver 26 is less reflective. Here a generally specular reflection is illustrated. A portion 170 of light 168 is then reflected by receiver 26 and passes through fused toner image 132 a second time. Again, to the extent that there is any colorant in fused toner image 132, a portion of light 170 is also absorbed so that a smaller portion of light 170 passes through viewing surface 130 of fused toner image 132 and back into wax globule 152 as light 172. Light 172 passes through wax globule 152 at an angle that is determined according to the angle of incidence of light 172 at the lower boundary 156, the index of refraction of wax 150, and the index of refraction of fused toner image 132.

To the extent that the material forming wax globule 152 absorbs light in a non-uniform manner and to the extent that wax globule 152 may have non-uniform wax densities or porosity or other materials therein, a portion of secondary gloss reflection 169 and light 172 will be absorbed by wax globule 152. Further, to the extent that wax globule 152 can cause a portion of secondary gloss reflection 169 and light 172 to be reflected or reemitted within wax globule 152 such as by reflection, local illumination, absorption and reemission, or other known optical effects a portion of secondary gloss reflection 169 will be reemitted as light 173 and a portion of light 172 as light 174 both apparently from within wax globule 152.

Light 174 travels at an angle that is determined by the angle of incidence of light 172, the index of refraction of wax 150 and the index of refraction of air or whatever medium surrounds wax globule 152. It will be noted that the angle of incidence is generally determined according to a tangent taken at the upper boundary 154 of wax globule 152. Similarly, any remaining portion of secondary gloss reflection 169 passes through upper boundary 154 to become light 171 that travels at an angle that is generally determined by the angle of incidence of secondary gloss reflection 169, the index of refraction of wax 150 and the index of refraction of air or whatever medium surrounds wax globule 152. Here too, the angle of incidence is determined according to a tangent taken at upper boundary 154 of wax globule 152.

It will be appreciated from this that the presence of wax globule 152 creates a number of effects on light that is incident on fused toner image 132 that can negatively impact the gloss of a fused toner image 132. These include at least providing specular reflection of light 160 as wax gloss reflection 162 that is directed along a path that is not parallel to toner gloss reflection 136, providing a secondary toner gloss reflection 169 that creates a light 171 that is also not parallel to toner gloss reflection 136. Additionally, the wax itself can have a different reflectance than toner 24 used to form fused toner image 132. These effects create variations in the gloss of viewing surface 130 of fused toner image 132 between the first portions 146 and second portions 148 of fused toner image 132 that generally reduce the apparent gloss of the fused toner print 120.

Additionally, it will be appreciated that the presence of wax globule 152 can also negatively impact image densities in fused toner print 120. In particular, wax globules 152 create uneven illumination of fused toner image 132. Wax globules 152 can also create image independent low density areas where there is light emission from the wax globules 152. Wax globules 152 also reduce the apparent sharpness of fused toner image 132 by causing localized variations in the path of travel of light through wax globule 152.

It will also be appreciated that these effects are exacerbated by the irregular, indistinct, or blob-like form of wax globules 152. In particular, the form of wax globules 152 significantly influences the direction of gloss producing reflections, and further alters a path of travel of light that passes through wax globule 152 to cause secondary gloss reflections to occur in directions that are inconsistent with a direction of toner gloss reflections. Further the form of wax globules 152 can provide areas within a single wax globule 152 where light that travels through wax globule 152 is reflected differently or has a greater opportunity for deflection, internal reflection or reemission than light that strikes other portions of wax globule 152. This can enhance the above described effects and therefore make the gloss and density variations caused by such effects more evident.

However, the fundamental challenges associated with efforts to fully remove wax 150 from a fused toner image 132 remain. Specifically, while improvements in gloss and in image density sought after by the prior art are desired, it is unacceptable to attempt to remove wax in a way that risks damaging viewing surface 130 of fused toner image 132.

Accordingly, toner printer 20 of FIG. 1 is shown having a wax management system 100 that is positioned to accept a fused toner image 132 and receiver 26 from fuser 60 and to process the fused toner image 132 to manage the wax globules 152 thereon to improve the gloss and optionally the image density of fused toner image 132. As is shown in FIG. 1, a print transfer system 103 is used to transfer fused toner print 120 from fuser 60 to wax management system 100. Print transfer system 103, wax management system 100 and controller 82 operate to provide controlled delivery of fused toner print 120 to wax management system 100. As is also shown in FIG. 1, an optional cooling system 105 is provided that can apply an air flow to cool fused toner print 120 before wax management is performed. Cooling system 105 can supply chilled air or a flow of ambient air. In other embodiments cooling system 105 can be integrated with fuser 60 such as where a belt type fuser is used that maintains contact with a fused toner image 132 in order to ferrotype the fused toner image 132. Similarly print transfer system 103 can be integrated into either of fuser 60 or wax management system 100. Print transfer system 103 and optional cooling system 105 are shown connected to controller 82 allowing controller 82 to influence the operation of these systems.

Figure 8:
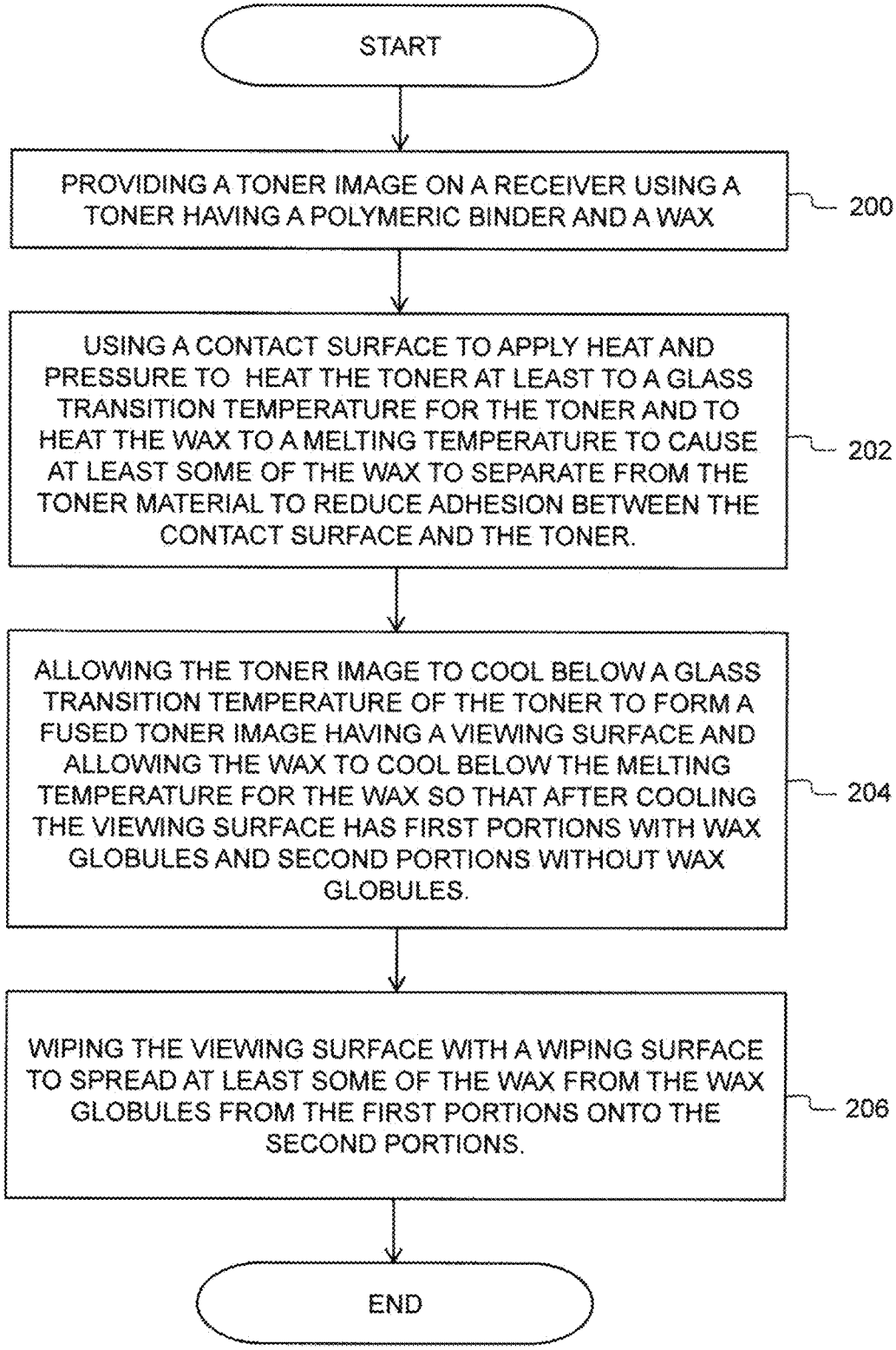
FIG. 8 illustrates one embodiment of a method for operating a printer having a wax management system.

FIG. 8 shows one embodiment of a method for operating a toner printer 20 having a wax management system 100. In this embodiment, a toner image 25 is provided on receiver 26 using a toner 24 having a polymeric binder and a wax 150 (step 200). Wax 150 separates from the particles of toner 24 when they are heated to an incorporated melting temperature for incorporated wax 150. Wax 150 acts as a release agent to limit the extent to which an adhesive bond can form between particles of toner 24 and a contact surface such as heated roller 72 of FIG. 2 during contact fusing.

A useful consideration in selecting wax 150 is the melting temperature of wax 150. In certain embodiments, wax 150 can have a melting point above the glass transition temperature of toner 24. It is generally preferred to have the melting point of wax 150 above the toner glass transition temperature but below the fusing temperature since this will allow the toner to enter a glassy state before the wax melts. This allows wax 150 to melt upon contact with a heated contact surface such as heated roller 72 to form slip layer that reduces adhesion between toner 24 and the contact surface. The thermal characteristics of toner 24, such as a glass transition temperature of toner 24 and an incorporated wax melting point of a wax 150 that is incorporated into a toner 24, can be determined by conventional methods, e.g., differential scanning calorimetry (DSC). Here, the endothermic peak temperature is defined as a melting point of a wax. If a wax has multiple peaks, the melting point is the lower peak temperature.

A wax 150 with a very high melting point can require higher fusing temperatures and can hinder the speed at which toner image 25 will be fused. A wax 150 having a very low melting point can limit the durability of the post fused image, particularly where a toner 24 having such a low melting point wax is fused at a high fusing temperature. In one embodiment wax 150 has a melting point temperature that is 5 degrees Celsius greater than a glass transition temperature of toner 24. In other embodiments, wax 150 can have a melting point that is less than 100 degrees Celsius.

Examples of such waxes include polyolefins such as polyethylene wax and polypropylene wax, and long chain hydrocarbon waxes such as paraffin wax. Another class of waxes is carbonyl group containing waxes which can include long-chain ester waxes. The waxes WE-3 and WE-8 made by NOF Corporation of Japan are long-chain ester waxes made from long-chain fatty acids and alcohol. These waxes are preferred in certain embodiments because they have a narrow melting range and have melting points that are above typical toner glass transition temperatures of the binder resins in many conventional toners and further have melting points that are less than 100 degrees Celsius. For example, WE-3 has an unincorporated single melting point peak of 70.8 degrees Celsius while WE-8 has two endothermic peaks of 71.8 and 80.2 degrees Celsius for an unincorporated melting point of 71.8 degrees Celsius. In certain embodiments, the glass transition temperature of the binder polymer can be between about 40 degrees Celsius and 80 degrees Celsius. In other embodiments, the glass transition temperature of the binder resin more typically between about 45 degrees Celsius and 70 degrees Celsius. In still other embodiments, the glass transition temperature of the binder resin can be between about between 50 degrees Celsius and 65 degrees Celsius.

In the embodiment of FIG. 8, printer controller 82 receives a print order and causes print engine 22 to generate a toner image 25 having a pattern of toner 24 based upon the print order and causes toner image 25 to be transferred to receiver 26. Printer controller 82 then causes receiver transport system 28 to carry toner image 25 and receiver 26 to a fuser 60.

A contact surface is used to apply heat and pressure to heat toner 24 forming toner image 25 at least to a glass transition temperature of the toner 24 and to heat wax 150 at least to an incorporated melting temperature of incorporated wax 150 (step 202). This causes at least some of wax 150 to separate from toner 24 to reduce adhesion between heated roller 72 and toner 24. In toner printer 20, fusing is done can be done as is described above using fuser 60 where the contact surface comprises heated roller 72. However in other embodiments, such a contact surface can take the form of a heated belt or platen or any other heated surface that directly contacts a toner image 25 during fusing.

Toner image 25 is allowed to cool below a glass transition temperature of toner 24 to form a fused toner image 132 having a viewing surface 130 and wax 150 is allowed to cool below a melting point of the wax 150 to form wax globules 152 (step 204) so that after cooling viewing surface 130 has first portions 146 with wax globules 152 and second portions 148 without wax globules 152. As is also discussed above, the presence of wax globules 152 causes first portions 146 and second portions 148 to reflect and transmit incident light in different ways and to have a first gloss and a second gloss, respectively that are different. As is discussed above, wax globules 152 can also cause density variations. In certain embodiments, controller 82 operates fuser 60, transport 103, and wax management system 100 so that wax management is performed after the toner image and the wax have been allowed to cool below the glass transition temperature of the toner and the melting temperature for wax 150. This can be done in a variety of ways and the exact manner of cooling is not critical. In one embodiment, the distance between fuser 60 and wax management system 100 and the rate of transport between fuser 60 and wax management system 100 can be selected to allow cooling when controller 82 causes transport to occur. In other embodiments, controller 82 can drive cooling system 105 and transport system 103 in ways that allow the cooling to occur. Other embodiments are possible.

Figure 9:
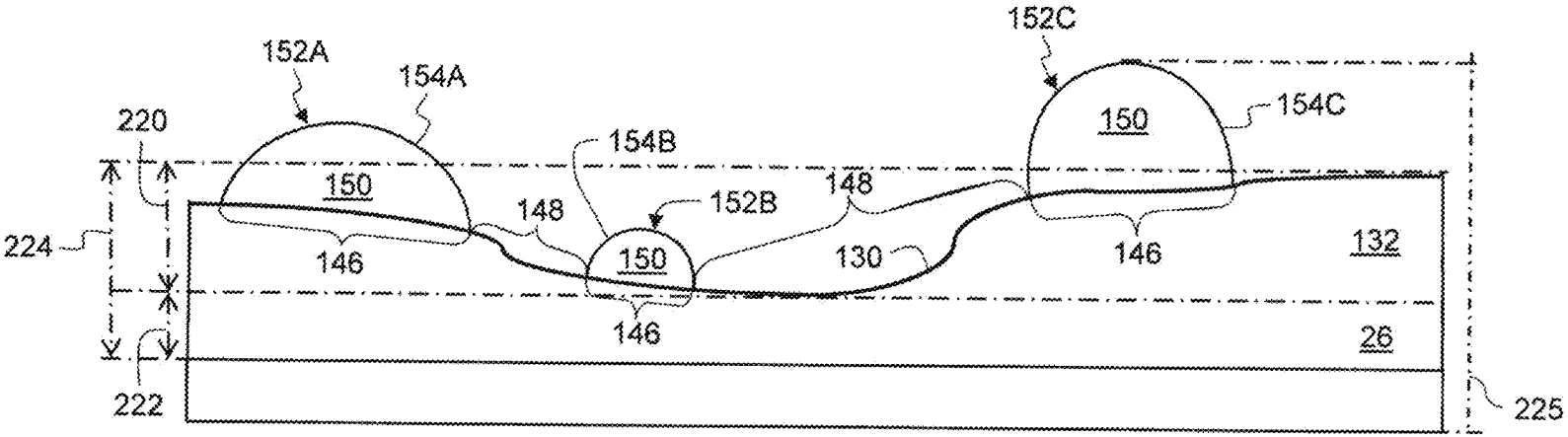
FIG. 9 presents a conceptual illustration of a fused toner image on a receiver having a viewing surface with wax globules thereon.

FIG. 9 presents a conceptual illustration of a fused toner image 132 on a receiver 26 having a viewing surface 130 with wax globules 152 thereon. FIG. 9 is not to scale. As is shown in FIG. 9, a fused toner image 132 has a viewing surface 130 with wax globules 152A, 152B and 152C arranged thereon in first portions 146 among second portions 148 of viewing surface 130. As is shown in FIG. 9 viewing surface 130 is not flat but varies within a range of heights 220 between a lower height 222 relative to receiver 26 and an upper height 224 relative to receiver 26. As will be appreciated from FIG. 9, such variations in height can also create gloss reducing variations on viewing surface 130. Wax globules 152A, 152B and 152C also have variable globule heights relative to viewing surface 130 and that can combine with the variations on viewing surface 130 to substantially increase the extent of total variations and therefore substantially reduce gloss.

Figure 10:
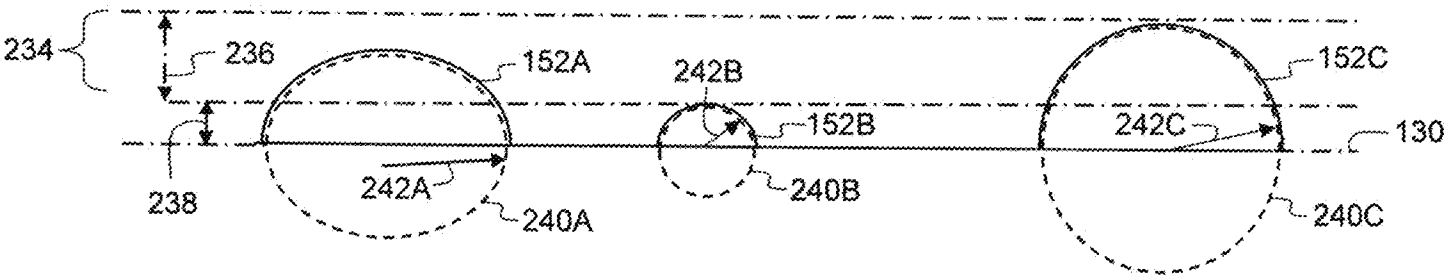
FIG. 10 illustrates, conceptually, a range of heights of wax globules relative to a baseline representing viewing surface.

FIG. 10 illustrates, conceptually, the range of heights of wax globules 152A, 152B and 152C relative a baseline 130 representing an average height of the viewing surface 130 on which wax globules 152A, 152B and 152C rest. As can be seen here, wax globules 152A, 152B and 152C have a range 234 of heights that are between a lower height 236 associated with wax globule 152B and a higher height 238 associated with wax globule 152C.

In FIGS. 9 and 10, wax globules 152A, 152B and 152C are shown having in a generalized fashion having substantially domelike shapes however as is apparent from FIGS. 3-6 wax globules 152 generally have an irregular, indistinct or other generally blob like shape. In FIG. 10 each wax globule 152A, 152B, and 152C is shown associated with a respective one of circles 240A, 240B and 240C. Circles 240A, 240B and 240C are each taken at a best fit to the general curvature of wax globules 152A, 152B and 152C and each has one of an associated first radius 242A, 242B and 242C. The radii 242A, 242B and 242C each generally correlate to an extent of curvature of upper boundaries 154A, 154B and 154C of wax globules 152A, 152B and 152C. It will be appreciated that the shape and extent of projection of upper boundaries 154A, 154B and 154B of wax globules 152A, 152B and 152C can have a significant impact on the extent of any variations in gloss or density caused by the presence of wax 150 on viewing surface 130.

This is particularly true where, as shown for wax globules 152A and 152C in FIG. 9, wax globules 152A and 152C add height to portions of viewing surface 130 that is already higher relative to receiver 26 than other portions of viewing surface 130 as measured relative to receiver 26. This is also particularly true where upper boundaries 154A, 154B and 154C have shapes that are relatively irregular as opposed to the regular type shapes illustrated in FIGS. 9 and 10.

Viewing surface 130 of fused toner image 132 is then wiped to move at least some of wax 150 from wax globules 152 in first portions 146 to second portions 148 (step 206). This can have the effect of reducing the extent to which wax 150 is organized into globules. This can also yield gloss and density improvements. Further, this can reduce the extent of differences between the gloss of first portions 146 and the gloss of second portions 148.

Figure 11:
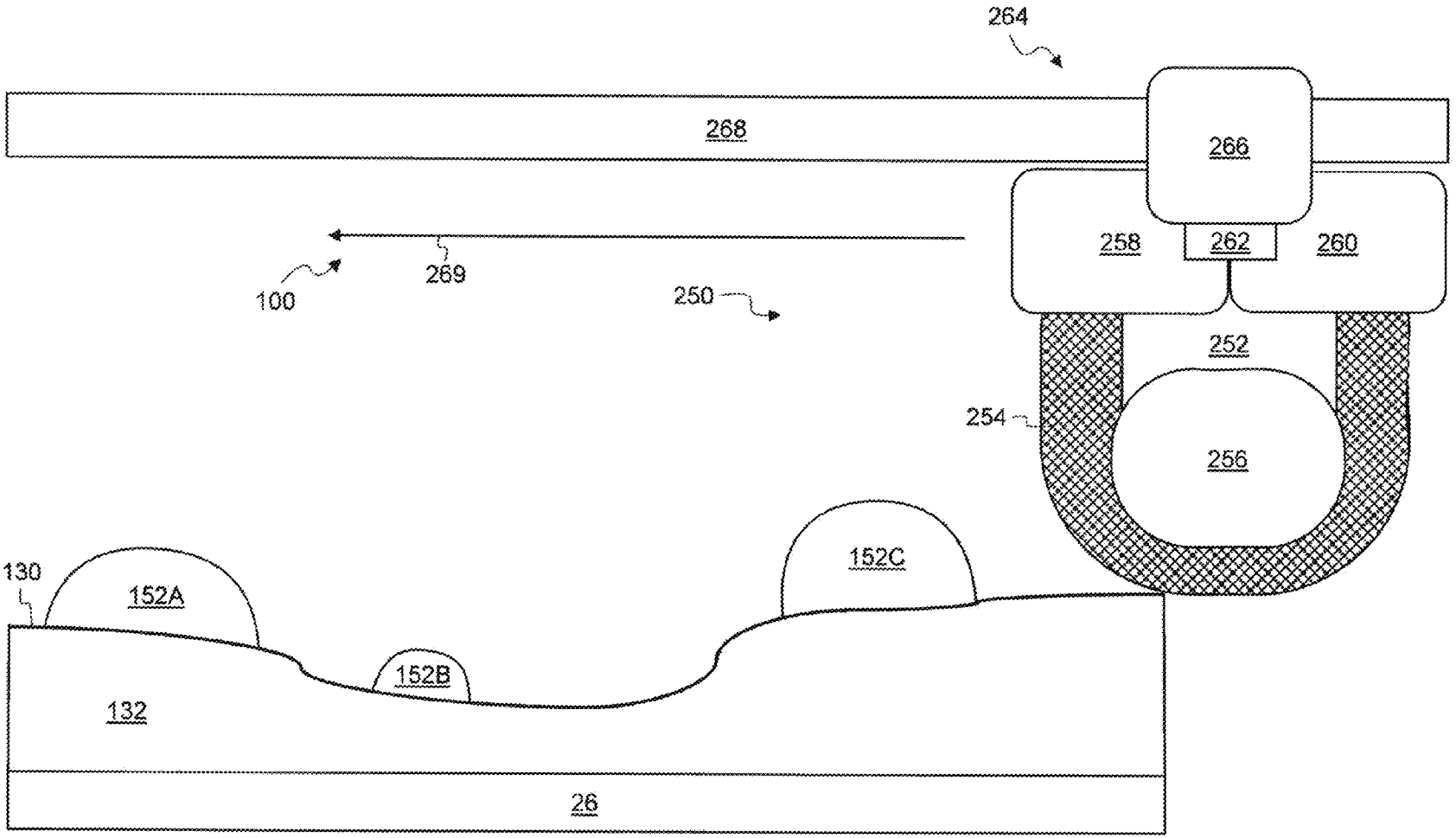
FIG. 11 shows one embodiment of a wax management system.

FIG. 11 shows one embodiment of a wax management system 100 that can be used for this purpose. In this embodiment wax management system 100 comprises a wiping system 250 having a wiping surface 254 that is wiped to move wax 150.

In this embodiment wiping system 250 comprises a wiping surface support 252 that supports a woven and compressible wiping surface 254 by way of an optional resilient intermediary 256 such as resiliently deformable foam. Wiping surface 254 can take any of a variety of forms and can comprise, for example, a paper, a fabric, a woven material, a polyester sheet or a fibrous surface or a polymeric or other form of material which itself can be compressible. Wiping surface 254 can be used repeatedly or cleaned or replaced as necessary. In the embodiment that is illustrated in FIG. 11, wiping surface 254 comprises a KIMTECH Science RTM Kimwipe sold by Kimberly-Clark, Dallas, Tex., USA that is mounting around wiping surface support 252 between a first mounting 258 and a second mounting 260. Optionally, first mounting 258 and second mounting 260 can comprise respectively a source and a take up that allow different portions of a wiping surface 254 to be rotated past a cleaning position on wiping member so that wax or any contaminants in wax globules 152A, 152B or 152C or any environmental contaminants such as dust, dirt, magnetic carrier, toner, metallic particles or wiping surface 254 do not have an opportunity to accumulate to the point where they can damage viewing surface 130.

In the embodiment of FIG. 11, wiping surface support 252 is shown optionally joined by a linkage 262 to a wiping actuator system 264 having an actuator 266 and a wiping rail 268. During wiping, actuator 266 moves along wiping rail 286 to move wiping surface support 252 and wiping surface 254 in a first wiping direction 269. Optionally, wiping can be done more than once and can be done along a plurality of different wiping angles relative to fused toner image 132. In one embodiment, this can be done by providing a wax management system 100 that has multiple combinations of a wiping surface support 252, a wiping surface 254 and a wiping actuator system 264 arrange to wipe from different directions during a single pass of the toner image 25 through wax management system 100. In another embodiment, this can be accomplished by positioning fused toner print 120 in wax management system 100 for wiping multiple times with rotation of fused toner image 132 and receiver 26 between wiping operation.

As performed here the wiping moves wax 150 from wax globules 1520 in first portions 146 onto second portions 148. This reduces the height or increases the radius of curvature of wax globules 152 in order to reduce the optical effects caused by wax globules 152. This improves the gloss of fused toner image 132 and makes the gloss response of first portions 146 and second portions 148 more consistent. Additionally, during wiping a portion of wax 150 moved from a wax globule may remain on wiping surface 254 and may be disposed in other ways. However, removal of all or substantially all of wax 150 sufficient to clean viewing surface 130 is not required. Accordingly, wiping system 250 need not apply sufficient force against viewing surface 130 to clean wax 150 from viewing surface 130. For example, wiping surface 254 can be supported by a resilient intermediary 256 that can be resiliently compressed so that wiping surface 254 will apply a limited amount of force during wiping that is insufficient to damage viewing surface 130. The resilient compressibility of the resilient intermediary 256 can be such that a wax globule 152 can cause wiping surface 254 to conform at least in part to the shape of wax globule 152. Where this occurs, the wiping force can be sufficient to remove only a part of wax 150 from a wax globule 152 and to reposition wax 150 from first portions 146 on which wax globule 152 rests to the second portions 148 of viewing surface 130.

The inventors have simulated the effects of a single pass multi direction wiping process manually. In this regard the test prints giving rise to the toner images shown in FIGS. 3-6 have were manually wiped at two different wiping angles relative to the viewing surface 130. In the test cases, this wiping has been done at wiping angles that are 90 degrees apart from each other. Gloss measurements were made before and after wiping. The results that were achieved are shown in Table I.

In examples 1 and 2, a first type of binder designated as BR1 was used. BR 1 comprises linear polyesters of bisphenol A and terephthalic acid. In examples 3 and 4 a second type of binder designated BR2 was used that comprised a blend of linear, cross-linked and branched polyesters of bisphenol A and terephthalic acid. The 15:3 Phthalocyanine Blue colorant levels associated with the BR1 and BR2 were 3.9 and 4.4 weight percent respectively.

TABLE I

| Binder | Wax | Toner Glass Transition Temp. ° C. | Incorp. Wax Melting Point Temp. ° C. | Fusing Temp. ° C. | Original Gloss | Managed Gloss | Delta Gloss | % Gloss Change |
|---|---|---|---|---|---|---|---|---|
| Ex. 1 BR1 | WE-8 | 61.4 | 72.3 | 160 | 66 | 75 | 9 | 14% |
| Ex. 2 BR1 | WE-3 | 60.2 | 69.9 | 160 | 81 | 83 | 2 | 2% |
| Ex. 3 BR2 | WE-8 | 56.5 | 71.6 | 130 | 12 | 12 | 0 | 1% |
| | | | | 140 | 21 | 24 | 3 | 12% |
| | | | | 150 | 26 | 30 | 4 | 17% |
| | | | | 160 | 42 | 50 | 9 | 21% |
| | | | | 170 | 52 | 66 | 14 | 27% |
| | | | | 180 | 59 | 71 | 12 | 20% |
| Ex. 4 BR2 | WE-3 | 54.2 | 69.9 | 130 | 12 | 12 | 0 | 0% |
| | | | | 140 | 23 | 24 | 1 | 4% |
| | | | | 150 | 31 | 32 | 1 | 3% |
| | | | | 160 | 49 | 50 | 1 | 3% |
| | | | | 170 | 64 | 67 | 3 | 5% |
| | | | | 180 | 71 | 75 | 4 | 6% |

All gloss measurements shown in Table I are G-60 gloss measurements determined using a Gardener Micro-TRI-Gloss 20-60-85 Glossmeter available from BYK, Gardner River Park, Maryland, USA. Toner glass transition temperature and incorporated wax melting point temperature were determined from a second heating cycle of an 8 to 12 mg. toner sample using a differential scanning calorimeter (Q100 manufactured by IA Instruments of New Castle Delaware). The toner sample was treated by raising its temperature to 150 degrees Celsius at a heating rate of 10 degrees Celsius/min. cooling the sample at a cooling rate of 20 degrees Celsius/ min. to 25 degrees Celsius and thereafter heating the sample at a heating rate of 10 degrees Celsius/min. to 150 degrees Celsius.

These results show that there has been a substantial increase in gloss performance using these wiping techniques. Further, it will be noted that, although not measured, a density increase in the wiped patches was also observed.

Figure 12:
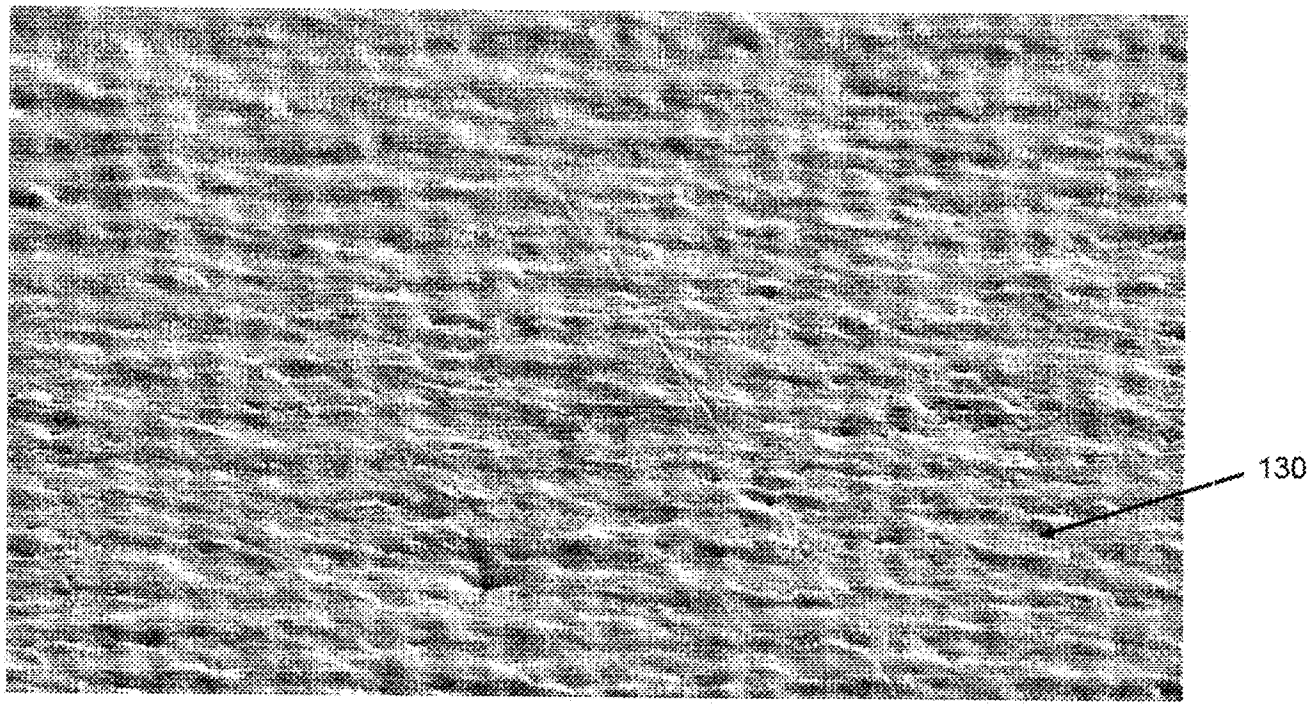
FIG. 12 shows an image of one example of a viewing surface of a toner image fused at the first temperature after wax management and at 2000× magnification.
Figure 13:
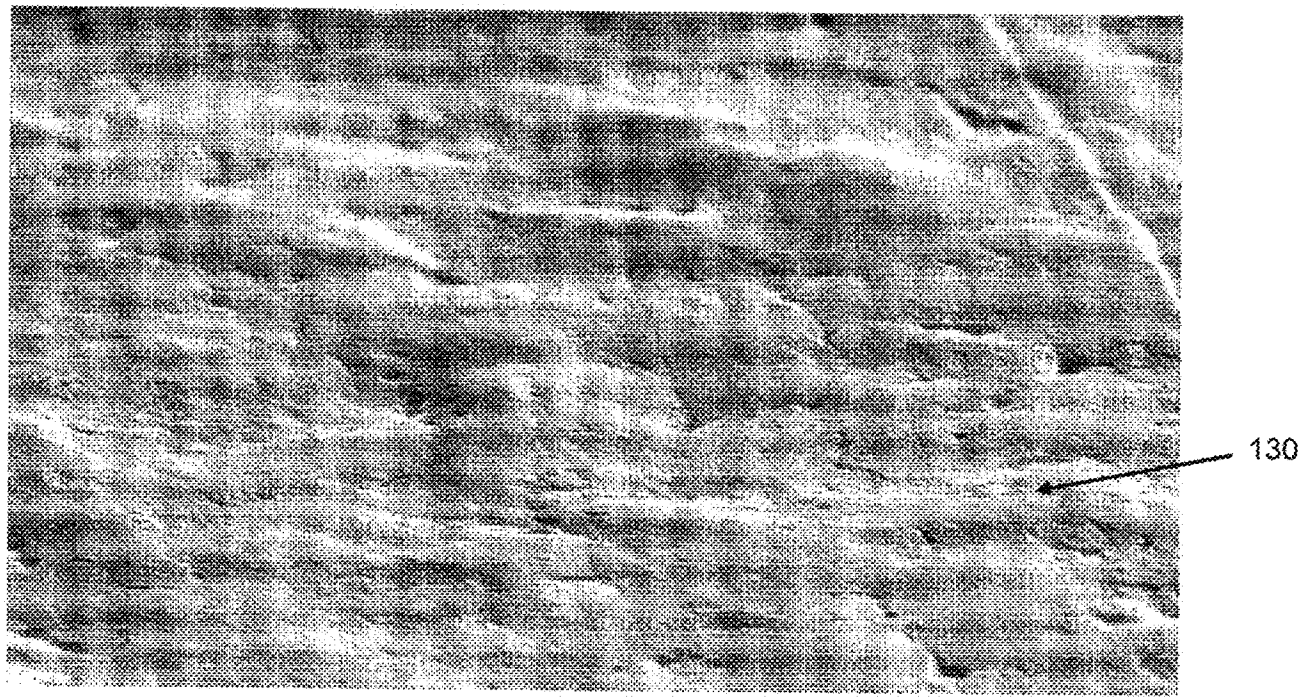
FIG. 13 shows an image of one example of a viewing surface of a toner image fused at the first temperature after wax management and at 10000× magnification.
Figure 14:
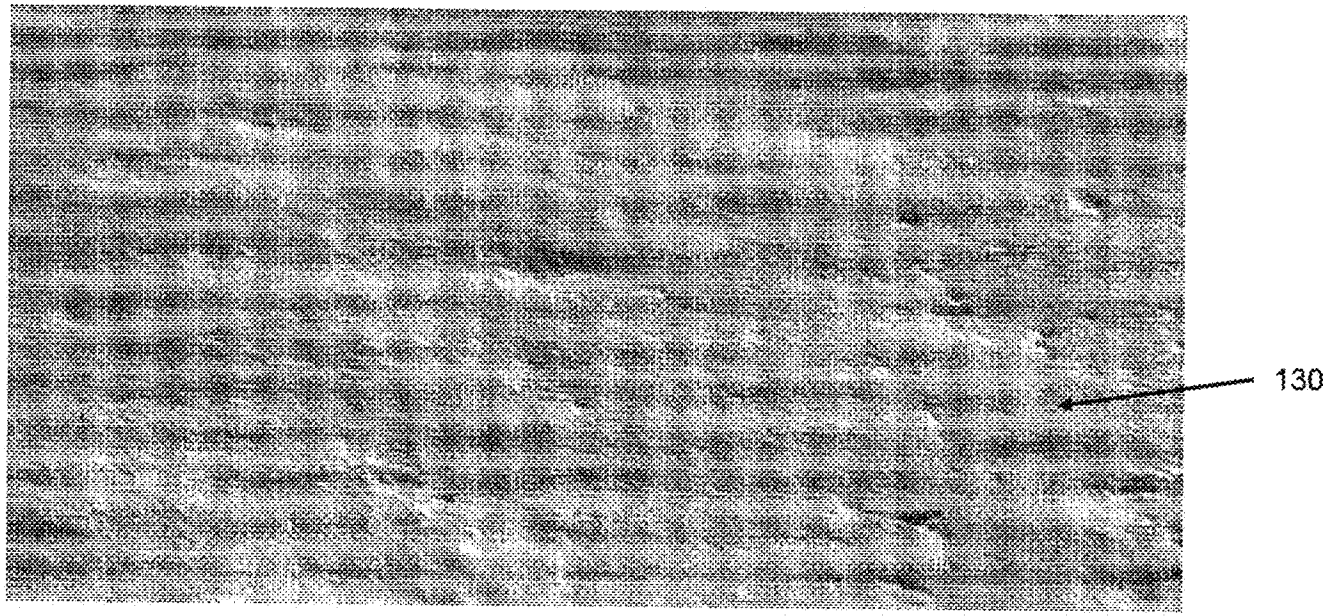
FIG. 14 shows an image of one example of a viewing surface of a toner image fused at the second temperature after wax management and at 10000× magnification.

The effects of such wiping are further illustrated in FIGS. 12-14. FIG. 12 shows post wiping images of a viewing surface 130 having a toner image 25 fused at a first temperature of 140 degrees Celsius and magnified at 2000× while FIG. 13 shows a post wiping view of one example of a viewing surface 130 of a toner image fused at temperature of 140 degrees Celsius at a magnification of 10,000×. Wax globules 152 are difficult to discern even at this high magnification.

FIG. 14 shows a 10000× magnified image of a post-wiping viewing surface 130 of a fused toner image 132 that has been fused at a temperature of 160 degrees Celsius. Here too wax 150 in the form of wax globules 152 is difficult to detect.

Although it is difficult to see any wax 150 in the form of wax globules 152 in FIGS. 12, 13, and 14, further analysis of the test patches used in this analysis reveals that wax 150 is still present on viewing surface 130 of these fused toner image 132. Specifically, the toner images that have exhibited improved gloss after wiping were subsequently subjected to a ball point pen writeability test. While writeability improved, indicating that some of the wax was removed, writeability was still compromised compared to non-wax containing toner images indicating the continued presence of wax in quantities sufficient to interfere with writeability, but not in the globular form. This indicates that gloss improvements and density improvements are possible without fully cleaning the wax from the surface of the toner image. With this understanding, it is clear from FIGS. 12-14 that at a minimum as a consequence of the wiping process, the relief differentials crated by any pattern of wax 150 is now difficult to distinguish from normal variations in viewing surface and therefore the effects of such variations are difficult to distinguish making these effects essentially invisible.

Figure 15:
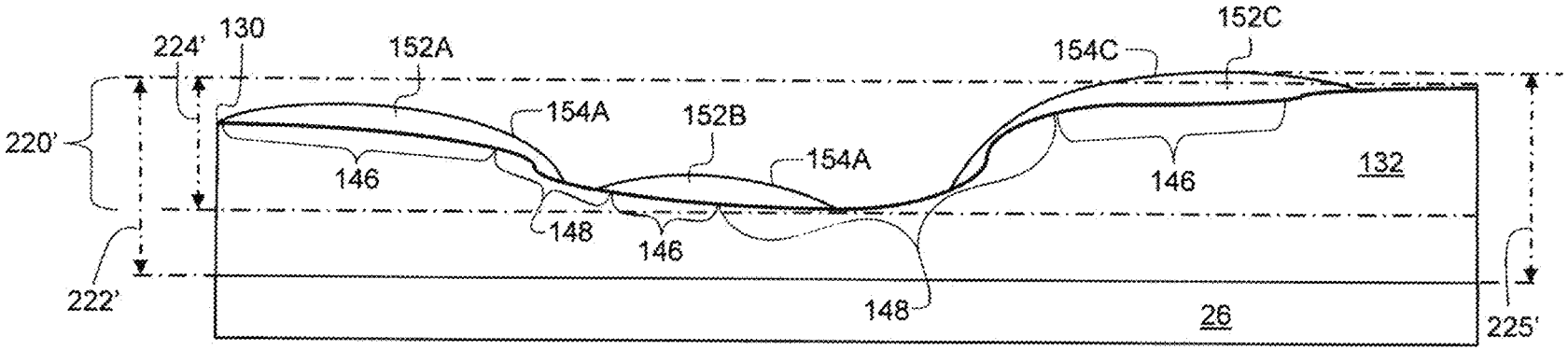
FIG. 15 presents a conceptual illustration of a fused toner image on a receiver having a viewing surface with wax globules thereon after fusing and wax management.
Figure 16:
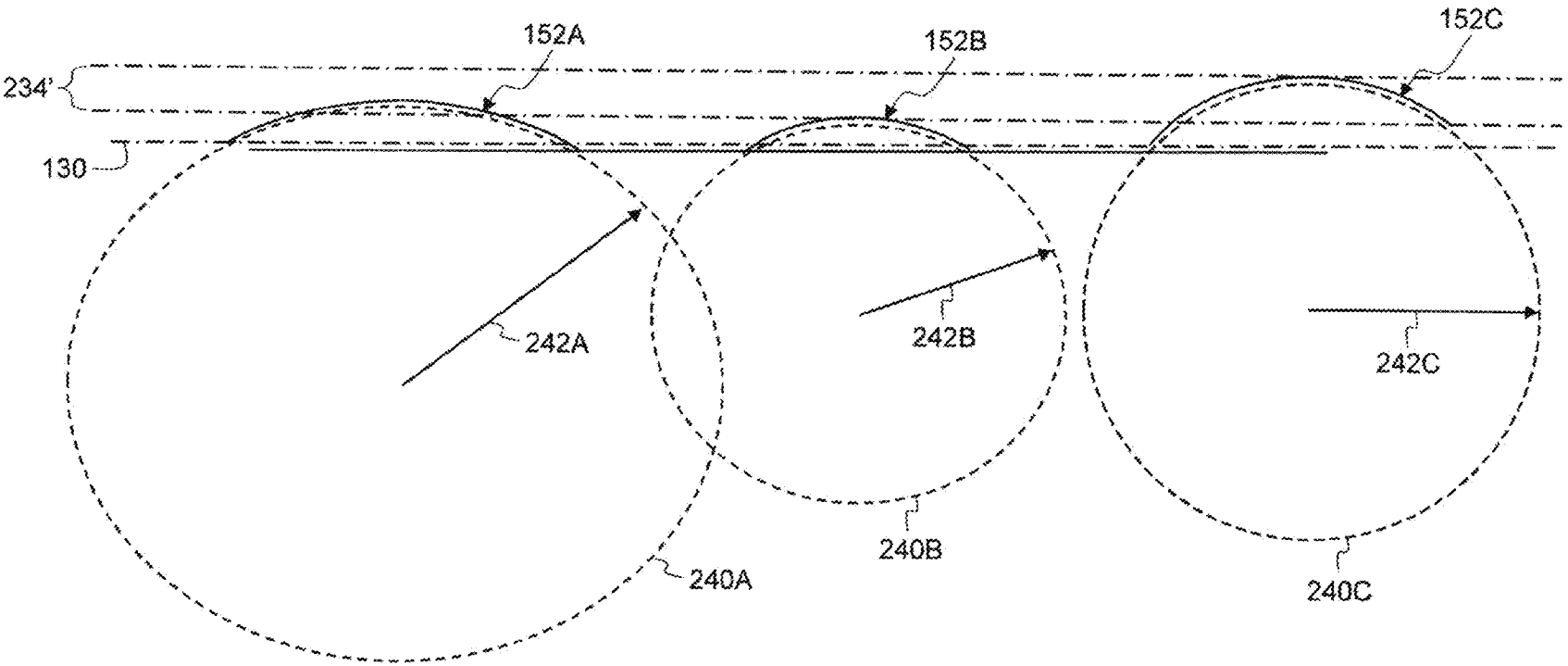
FIG. 16 illustrates, conceptually, a range of heights of wax globules relative to a baseline representing viewing surface.

In this regard, FIGS. 15 and 16, show respectively, a conceptual illustration of a fused toner image 132 on a receiver 26 having a viewing surface 130 with wax globules 152 thereon after fusing and wax management and, conceptually, a range of heights of wax globules 152 relative to a baseline representing viewing surface 130, after wax management. As is shown in FIGS. 15 and 16, there is a movement of wax 150 from wax globules 152 from first portions 146 at least in part to second portions 148. This significantly increases radii 242A, 242B and 242C that correlate to upper boundaries 154A, 154B and 154C of wax globules 152A, 152B and 152C as compared to the radii 242A, 242B and 242C illustrated in FIGS. 9 and 10 before wiping. As can be seen in FIGS. 5 and 9, viewing surface 130 and wax globules 152 on viewing surface 130 have a first range of total heights 225 above receiver 26 after fusing and have a second range 225' of total heights above receiver 26 after the wiping that is at least in part less than the first range 225 of heights. As can be seen in FIGS. 10 and 16 wax globules 152 on viewing surface 130 have a first range of globule heights 234 above viewing surface 130 after fusing that is at least in part greater than a second range 234 of wax globule heights above viewing surface 130 after wiping.

These conditions improve the gloss of fused toner image caused by wax globules 152 at least in part by reducing the extent of any relief patterns caused by wax globules 152 and optionally can be established so that that after cooling the fused toner image 132 has a viewing surface 130 with heights that vary within a range of viewing surface heights and wherein after wiping viewing surface 130 and wax 150 on viewing surface 130 have a range of total heights that is within the range of variations of viewing surface heights so that any additional height provided by the wax 150 on viewing surface 130 does not increase the extent of any gloss variations beyond the variations caused by variations in the height of viewing surface 130.

This reduces gloss variations by diminishing the scattering of light caused by different angles of specular reflection created by upper boundaries 154A, 154B and 154C of wax globules 152A, 152B and 152C and further reduces the extent to which a beam of light must travel through wax in a wax globule thereby reducing the opportunity for the light to be reflected or deflected by materials in the wax thus improving gloss. Further to the extent that such gloss variations caused by wax 150 on viewing surface 130 continue to exist after wiping, these effects are more evenly distributed across the viewing surface 130 and therefore create less of a variation. For similar reasons, density variations cause by wax 150 and in particular by wax globules 152 will be reduced.

Further it will be appreciated that the overall extent of height variations along viewing surface 130 can be reduced in this manner in some instances. As is shown in FIG. 15 the portion of viewing surface 130 that is covered in wax 150 expands while the uncovered portion contracts after wiping.

Figure 17:
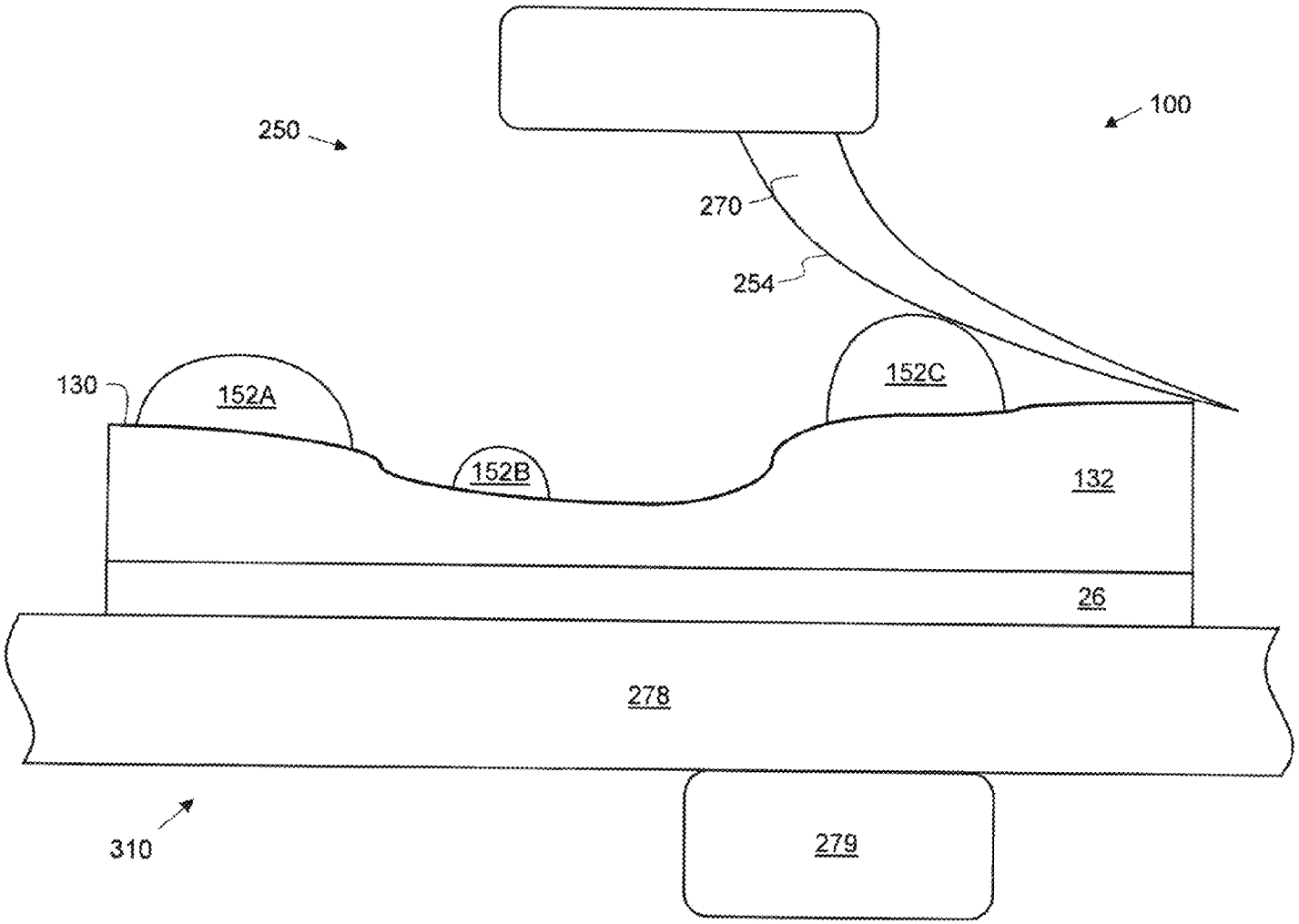
FIG. 17 illustrates another embodiment of a wax management system.
Figure 18:
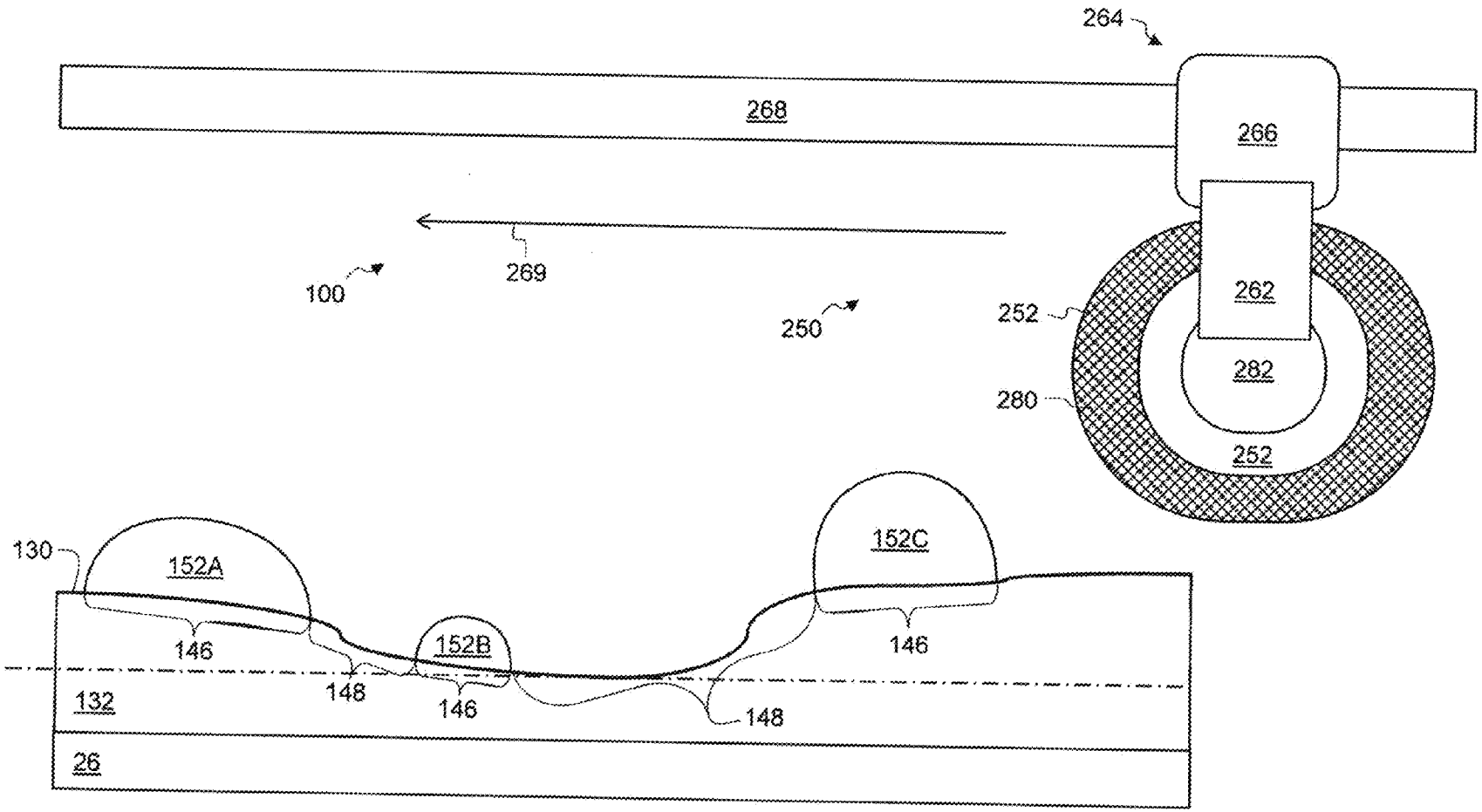
FIG. 18 illustrates another embodiment of a wax management system.

FIG. 17 illustrates another embodiment of a wax management system 100. In this embodiment, wiping system 250 comprises a resilient wiper blade 270 having a shallow working angle between a wiping surface 254 of wiper blade 270 and viewing surface 130. Such a shallow working angle, in the range of 2 to 40 degrees is not particularly effective at removal of wax 150 and will move at least some of the wax 150 from wax globules 152 in first portions 146 to second portions 148. This can also be used in certain embodiments to help to ensure that wherever possible some wax 150 from wax globules 152A, 152B and 152C is maintained between wiper blade 270 and viewing surface 130 so as to minimize direct contact between wiper blade 270 and viewing surface 130 and can act, as a friction reducing lubricant between wiper blade 270 and viewing surface 130 during wiping. This lubrication effect can also arise in other embodiments. As is also shown in this embodiment, it is not necessary that a wiping system 250 have a wiping surface 254 that is movable relative to a viewing surface 130 of a fused toner image 132 on a fused toner print 120 and a system for moving wiping surface 254. Instead as is shown in this embodiment, a wax management system 100 can have a print positioning apparatus 310 for moving a fused toner print 120 during wiping. For example, as is shown in FIG. 18, print positioning apparatus 310 can be moved to provide a support 278 such as a belt or roller system that an actuator 279 moves to advance fused toner print 120 past wiping surface 254 to wipe viewing surface 130.

In other embodiments wax management system 100 can take other forms. For example, as is shown in FIG. 18, wax management system 100 has a roller 280 with a wiping surface 254. Roller 280 is supported by and is rotatable around a wiping surface support 252. Wiping surface support 252 in turn is optionally joined by a linkage 262 to an actuator system 264. Actuator system 264 has an actuator and a wiping rail 268. During wiping, actuator system 264 moves along wiping rail 268 to move wiping surface support 252 and therefore roller 280 and wiping surface 254 along first wiping direction 269. In this embodiment, support 252 includes a rotation control system 282 that controls rotation of roller 280 about support 252. In the embodiment that is illustrated in FIG. 18, rotation control system 282 has an actuator such as a motor that can control or influence a rate of rotation of roller 280 during the wiping process. The rate of rotation of roller 280 can be less than a relative rate of movement between roller 280 and viewing surface 130 to encourage wax movement. In other embodiments of this type, roller 280 can be made to rotate as a product of contact with viewing surface 130 and in such an embodiment, rotation control system 282 can comprise any form of transmission, linkage or braking system that limits a rate of rotation of roller 280 such that roller 280 rotates at a rate that is less than a rate of movement of roller 280 across viewing surface 130 during wiping. It will be appreciated that, in order to protect against scraping viewing surface 130, it will be beneficial in certain embodiments to provide the movement of wax 150 without creating a risk of unnecessary friction between wiping surface 254 and viewing surface 130.

In other embodiments, wiping surface 254 can be a web such as is described above that is supported by roller 280.

In one embodiment the surface of roller 280 is elastomeric and is sufficiently resiliently compressible such that a wax globule 152 can cause a wiping surface 254 to conform at least in part to the shape of wax globule 152. Where this occurs, the force applied by the roller 280 can be sufficient to move only a part of any wax 150 forming wax globules152 from first portions 146 to second portions 148 of viewing surface 130.

Wax management system 100 can be integrated into a printer 20 or can act as a standalone device that receives toner prints from printer 20 and that manages the wax thereon in line with printer 20 as a standalone device that can be used as needed. In this regard, printer 20 can have a wax management system 100 that is integral to toner printer 20 or wax management system 100 can be separable from toner printer 20 such as a modular attachment. In still another embodiment, printer 20 can be use with a stand alone wax management system 100 that can be used to manage wax 150 on fused toner prints made by toner printer 20 but that can be used in cooperation with printer 20 or without any connection with toner printer 20.

It will be appreciated that such a standalone embodiment can be used to perform wax management on fused toner prints 120 on an as needed basis and on fused toner prints 120 that have been printed hours, days or months before being submitted for wax management. Further, it will be appreciated that such stand alone embodiments of wax management system 100 can manage wax 150 on a viewing surface 130 of a fused toner image 132 without requiring that wax 150 be in a liquefied state. This allows such stand alone embodiments to be used without requiring that fused toner image 132 be at an elevated temperature required to heat wax 150 above a melting temperature for wax 150.

Figure 19:
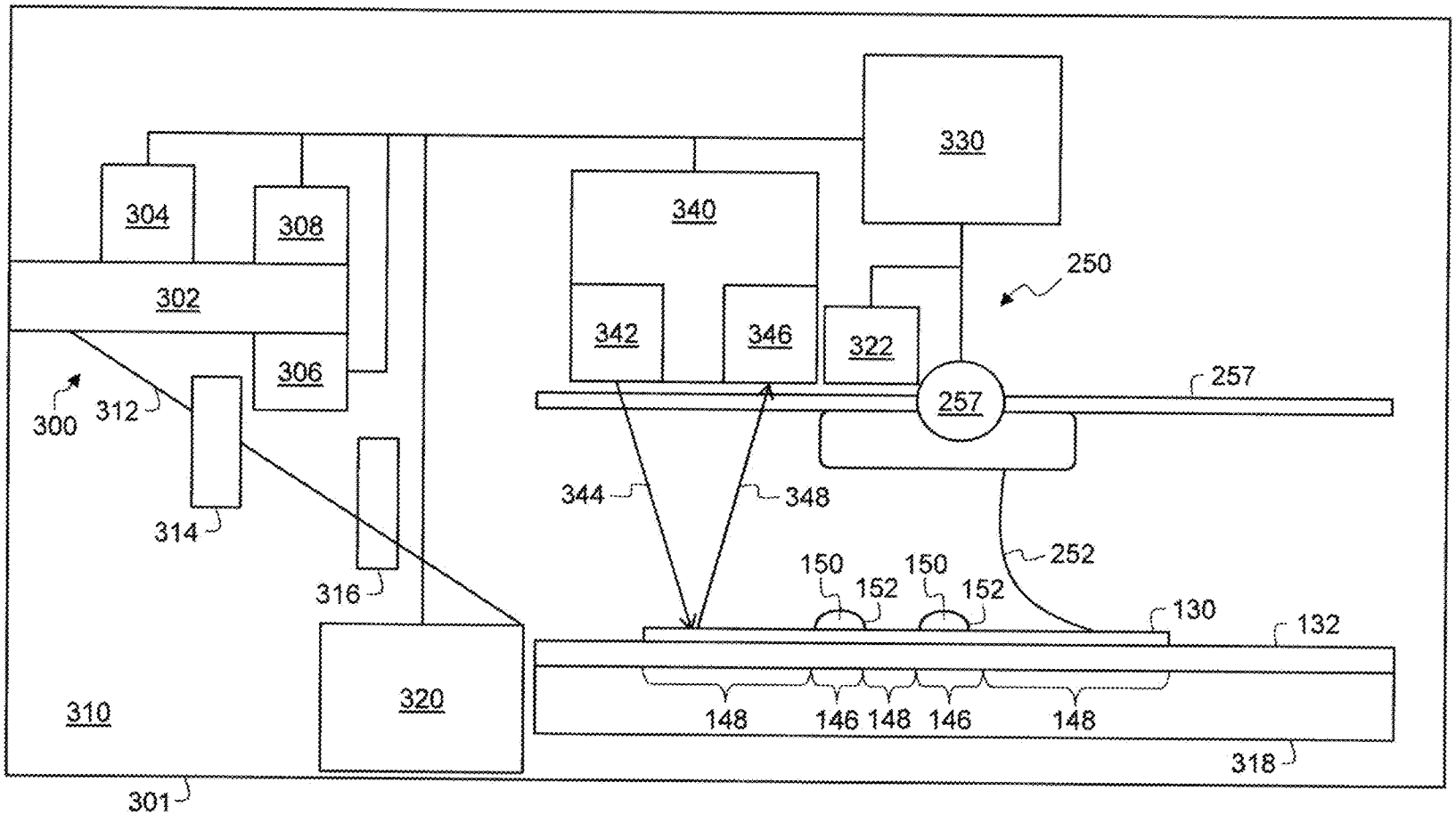
FIG. 19 illustrates a stand alone embodiment of a wax management system.

FIG. 19 illustrates another example of such a standalone embodiment of a wax management system 100 in greater detail. As is shown in FIG. 19, in this embodiment, wax management system 100 has a print positioning system 300 that is generally contained or supported by a housing 301. Print positioning system 300 has an input 302 that receives a fused toner print 120 from outside of housing 301. Fused toner print 120 has a fused toner image 132 with a viewing surface 130 that has first portions 146 with wax globules 152 and second portions 148 without wax globules 152.

In this embodiment, print positioning system 300 also has a print positioning apparatus 310 that is used to position fused toner print 120 for wiping by a wiping system 250. Here, print positioning apparatus 310 comprises a carrier surface 312 that carries fused toner print 120 from input 302 past an arrangement of guides 314 and 316 that contact sides of fused toner print 120 to position fused toner print 120 for wiping. In the embodiment illustrated carrier surface 312 comprises a slide surface that uses gravity to draw fused toner print 120 from input 302 to a wiping surface 318 where fused toner print 120 is positioned for wiping by a wiping system 250. However, in other embodiments, carrier surface 312 can be, for example, an endless belt, a powered arrangement of rollers, or any other known conveyance systems that can cause a fused toner print 120 to move from one position to another.

As is also shown in FIG. 19, in this embodiment wax management system 100 has a wax management system controller 330 that communicates with a presence sensor 304 to sense the presence of fused toner print 120 at input 302 and that further communicates with one or more actuators 306 that control print positioning apparatus 310, in order to ensure that a fused toner print 120 is positioned for wax management by wiping system 250 and in order to ensure that wiping system 250 successfully wipes fused toner print 120. Presence sensor 304 can comprise any known form of sensor that can be used to detect signals from which the presence or absence of fused toner print 120 can be determined.

As is also shown in FIG. 19, wax management system 100 can further comprise an optional cooling system 320. Cooling system 320 cools fused toner print 120 before wiping. Cooling system 320 can comprise a contact cooling system, a forced air cooling system or other conventional forms of cooling systems.

A first temperature sensor system 308 and a second temperature sensor system 322 are shown in FIG. 19. First temperature sensor system 308 is positioned to sense the temperature of a fused toner print 120 at input 302 while second temperature sensor system 322 is shown positioned to sense a temperature of a fused toner print 120 that is positioned for wiping by wiping system 250. Temperature sensor systems 308 and 322 can comprise infra red sensitive devices such as an optical switch, photosensor or imager that can detect a temperature of a fused toner print 120 for use in controlling cooling system 320 or wiping system 250. Any other form of sensor that can detect a temperature or any other condition indicative of the temperature of a fused toner print can also be used.

In the embodiment of FIG. 19, presence sensor 304 detects the presence of a fused toner print 120 and sends a signal to wax management system controller 330 from which wax management system controller 330 can determine that fused toner print 120 is in input 302.

Wax management system controller 330 then determines when the fused toner image 120 is at a temperature where fused toner image 132 is below a glass transition temperature of the toner 24 forming fused toner image 132 and wax 150 is below a melting temperature for wax 150. In this embodiment, this is done using first temperature sensing system 308 positioned in input 302. When wax management system controller 330 determines that fused toner print 120 is not at an appropriate temperature, wiping of the fused toner print 120 can be delayed to allow cooling. Additionally, optional cooling system 320 can be activated to accelerate such cooling.

After it is determined that a fused toner print 120 is at a temperature where fused toner image 132 is below a glass transition temperature of the toner 24 and the wax 150 is below a melting temperature for wax 150, wax management system controller 330 can cause print positioning apparatus 310 to position fused toner print 120 for wiping. Wax management system controller 330 then causes print positioning apparatus 310 to move cooled fused toner print 120 to wiping system 250. Once fused toner print 120 is positioned relative to wiping system 250, wax management system controller 330 causes wiping system 250 to cause wiping surface 254 to wipe viewing surface 130 to move at least some of wax 150 from wax globules 1.52 in first portion 146 onto second portion 148.

Alternatively, wax management system controller 330 can cause print positioning apparatus 310 to move fused toner print 120 to wiping system 250 and can cause wiping system 250 to delay wiping until second temperature sensor system 322 sends signals to wax management system controller 330 from which wax management system controller 330 can determine that fused toner image 132 is below a glass transition temperature of toner 24 and wax 150 is below a melting temperature for wax 150. In this alternative embodiment, second temperature sensing system 322 can be used to monitor the temperature of any fused toner print 120 at wiping system 250.

It will be appreciated by those of skill in the art that first temperature sensor system 308 and second temperature sensor system 322 can be used in various combinations to provide signals to wax management controller 332 to allow wax management system controller 330 to ensure that wax management is not performed until the toner forming toner image 24 is below a glass transition temperature of toner 24 and wax 150 is below a melting temperature for wax 150.

In other embodiments, other methods can be used to ensure that wiping is performed when fused toner image 132 is below a glass transition temperature of the toner 24 and the wax 150 is below a melting temperature for wax 150, such as by providing a cooling system 320 that is capable of cooling any fused toner print to the desired conditions for wiping, or by transporting the fused toner print 120 such that sufficient time has been allowed for the fused toner print 120 to reach a condition where fused toner image 132 is below a glass transition temperature of the toner 24 and the wax 150 is below a melting temperature for wax 150.

It will also be understood that wax management system controller 330 can determine that fused toner image 132 is below a glass transition temperature of toner 24 and wax 150 is below a melting temperature for wax 150 in ways that do not require temperature sensing. For example, wax management system controller 330 can receive information from which wax management system controller 330 can determine that conditions indicate that cooling is sufficient. Examples of such information include but are not limited to data from which an amount of time since fusing can be determined, data from which an elapsed travel distance since fusing can be determined or data that indicates that cooling has been performed by toner printer 20 before transfer to wax management system 100.

In the embodiment of FIG. 19, wiping system is shown having a wiping surface 254 takes the form of a wiper blade that is moved along a track system 253 by an actuator 257. It will be appreciated that any embodiment of a wiping system 250 described herein can be used with stand alone embodiment of wax management system 100 to manage wax 150.

As is further shown in this embodiment, wax management system 100 has an optional gloss sensor system 340 with one or more light emitters 342 that apply a light 344 to viewing surface 130 and that has one or more light sensors 346 that are positioned to detect the extent to which viewing surface 130 reflects light 344 as a specular reflection 348. The amount of light sensed by light sensors 346 is then used by wax management system controller 330 or by a local gloss sensor controller (not shown) to determine an extent of the gloss of portions of viewing surface 130. It will be appreciated that gloss sensor system 340 can take the form of any other device that can be used to measure the gloss of a surface.

In one embodiment, a wax management system controller 330 can cooperate with cooling system 320, second temperature sensor system 322, gloss sensor system 340 and wiping system 250 so that wax management system controller 330 can control the wiping process based upon signals from the gloss sensor system 340, such as by determining a number of times that wiping is performed or determining a combination of different directions of the wiping based upon signals from gloss sensor system 340.

It will be appreciated that any other embodiment of wax management system 100 including those that are incorporated into a toner printer 20 or those that are incorporated into modules that are intended for use with but that are separable from toner printer 20 can also incorporate a cooling system 320, a wax management system controller 330 or a gloss sensor system 340 and/or any other features, methods or aspects of the embodiment of FIG. 19.

It will also be appreciated that where wax management system 100 is part of, is joined to or is otherwise in communication with a toner printer 20 any functions ascribed herein as being performed by wax management system controller 330 can be performed by printer controller 82.

What is claimed is:

1. A wax management system, comprising:

a print positioning system having an input to receive a fused toner print having a toner image with a viewing surface that has first portions with wax globules and second portions without wax globules and a print positioning apparatus that arranges the print for wiping by a wiping system having a wiping surface that wipes the viewing surface to move at least some of the wax from the wax globules in the first portion onto the second portion; and a wax management device controller to determine when the received toner image cools to a temperature where the toner image is below a glass transition temperature of the toner and the wax is below a melting temperature for the wax and to position the received fused toner print for wiping;

wherein the controller causes the wiping system to wipe the fused toner print after the controller determines that the fused toner print is at a temperature where the toner image is below a glass transition temperature of the toner and the wax is below a melting temperature for the wax.

2. The wax management system of claim 1, wherein after cooling the first portions have a first gloss and the second portions have a second gloss that is different than the first gloss, and wherein after wiping an extent to which the first gloss and the second gloss are different is reduced.

3. The wax management system of claim 1, wherein the wax globules on the viewing surface after cooling have a first range of wax globule heights above the viewing surface after the cooling that is at least in part greater than a second range of wax globule heights above the viewing surface after wiping.

4. The wax management system of claim 1, wherein the viewing surface and the wax on the viewing surface have a first range of total heights above the toner print after the fusing and wherein the viewing surface and wax on the viewing surface have a second range of total heights after the wiping that is at least in part less than the first range of total heights.

5. The wax management system of claim 1, wherein the viewing surface has a first gloss after the cooling of the viewing surface and a second gloss after wiping that is at least about 3 gloss units higher than the first gloss.

6. The wax management system of claim 1, wherein the viewing surface has a first gloss after the cooling of the viewing surface and a second gloss after wiping that is at least about 8 gloss units higher than the first gloss.

7. The wax management system of claim 1, wherein a portion of the wax moved from the wax globules acts as a lubricant between the wiping surface and the viewing surface.

8. The wax management system of claim 1, wherein the wax globules have a radius of curvature after the cooling that is within a first range of radii of curvature and wherein the wax remaining on the surface after the wiping has a second range of radii of curvature that is greater than any of the first range of radii.

9. The wax management system of claim 1, wherein the wiping is performed using a wiper blade.

10. The wax management system of claim 1, wherein the wiping is performed using a wiping surface comprising a paper, a fabric, a woven material, a polyester sheet a fibrous surface or a polymeric material.

11. The wax management system of claim 1, wherein the wiping is performed using a wiping surface that is compressible such that the wiping surface will yield if pressed against the viewing surface.

12. The wax management system of claim 1, wherein the wiping is performed using a wiping surface that is supported by a compressible elastomeric roller.

13. The wax management system of claim 1, wherein the wax has an incorporated melting point that is greater than a glass transition temperature of the toner.

14. The wax management system of claim 1, wherein the wax has an incorporated melting point that is about 5 degrees Celsius greater than the glass transition temperature of the toner material.

15. The wax management system of claim 1, wherein the wiping comprises wiping along a first wiping direction and a second wiping direction that is different from the first wiping direction.

16. The wax management system of claim 1, wherein the average height of the wax globules is reduced by the wiping.

17. The wax management system of claim 1, wherein a greater portion of the viewing surface is wax covered after the wiping than before the wiping.

18. The wax management system of claim 1, wherein movement of the wax further reduces variations in the density of the toner image caused by the wax.

19. The wax management system of claim 1, further comprising a gloss sensor having a light emitter and a light sensor arranged to detect conditions indicative of a gloss of the viewing surface and wherein the controller uses the detected conditions to determine at least one of a number of times for wiping the viewing surface or a combination of different directions for wiping the viewing surface.

20. The wax management system of claim 1, further comprising a cooling system that the controller uses to actively cool the fused toner image before wiping.

21. The wax management system of claim 1, wherein after cooling the fused toner image has a viewing surface with viewing surface heights above the receiver that vary within a range of viewing surface heights and wherein after wiping the viewing surface and the wax on the viewing surface have a range of total heights that is within the range of viewing surface heights.

22. The wax management system of claim 1, wherein the print positioning apparatus comprises an arrangement of alignment surfaces that position the print for the wiping as the fused toner print is moved past such alignment surfaces to a position where the fused toner print can be wiped.

23. The wax management system of claim 1, wherein the print positioning apparatus comprises a slide surface that allows gravity to urge the fused toner print to move past the alignment surfaces to a position where the fused toner print is positioned for wiping.

* * * * *